US010614641B2

(12) United States Patent
Lai

(10) Patent No.: US 10,614,641 B2
(45) Date of Patent: Apr. 7, 2020

(54) ELECTRONIC COMBINATION LOCK WITH DIFFERENT LEVELS OF ACCESS CONTROL

(71) Applicant: THE SUN LOCK COMPANY, LTD., Tuen Mun, N. T. (HK)

(72) Inventor: Karl Lai, Tai Po (HK)

(73) Assignee: The Sun Lock Company, Ltd., Tuen Mun, N.T. (HK)

( * ) Notice: Subject to any disclaimer, the term of this patent is extended or adjusted under 35 U.S.C. 154(b) by 214 days.

(21) Appl. No.: 15/883,598

(22) Filed: Jan. 30, 2018

(65) Prior Publication Data

US 2018/0165901 A1 Jun. 14, 2018

Related U.S. Application Data

(63) Continuation-in-part of application No. 15/700,502, filed on Sep. 11, 2017, which is a continuation-in-part (Continued)

(51) Int. Cl.
*G07C 9/00* (2020.01)
*E05B 49/00* (2006.01)

(Continued)

(52) U.S. Cl.
CPC ..... *G07C 9/00142* (2013.01); *E05B 47/0002* (2013.01); *E05B 47/0004* (2013.01);

(Continued)

(58) Field of Classification Search
None
See application file for complete search history.

(56) References Cited

U.S. PATENT DOCUMENTS 4,062,056 A 12/1977 Goodrich
4,148,092 A 4/1979 Martin (Continued)

FOREIGN PATENT DOCUMENTS

CN 2439512 7/2001
CN 203796000 8/2014

(Continued)

OTHER PUBLICATIONS

American Security LaGard Electronic Locks, http://www.amsecusa.com/lock-options/lagard-electronic-locks, printed Nov. 2, 2015 (3 pages).

(Continued)

*Primary Examiner* — Chico A Foxx
(74) *Attorney, Agent, or Firm* — Ware, Fressola, Maguire & Barber LLP

(57) ABSTRACT

A combination lock has a touch panel to receive a keypad entry code indicative of a combination code for unlocking the lock with various access levels, including a first level and second level. The combination lock is also arranged to receive the combination code from a mobile device via wireless signals. The combination lock also has an independent key-lock mechanism for unlocking the lock with a key. The mobile device has an application icon, when activated, prompting the wireless signals indicative of the combination code. The mobile device also has a deactivation icon and re-activation associated with the combination code of the first level. The deactivation icon causes the disablement of the touch panel and the key-lock mechanism when activated. The re-activation icon terminates the disablement of the touch panel and the key-lock mechanism when activated.

18 Claims, 35 Drawing Sheets

Related U.S. Application Data of application No. 15/351,708, filed on Nov. 15, 2016, now Pat. No. 10,267,062.

(60) Provisional application No. 62/266,052, filed on Dec. 11, 2015.

(51) Int. Cl.
*E05B 47/00* (2006.01)
*E05B 67/24* (2006.01)

(52) U.S. Cl.
CPC ..... *E05B 67/24* (2013.01); *G07C 9/00174* (2013.01); *G07C 9/00714* (2013.01); *E05B 49/00* (2013.01); *E05B 2047/0084* (2013.01); *E05B 2047/0095* (2013.01); *G07C 9/0069* (2013.01); *G07C 2009/00761* (2013.01)

(56) References Cited

U.S. PATENT DOCUMENTS 4,677,284 A 6/1987 Genest
4,838,052 A 6/1989 Williams et al.
4,931,789 A 6/1990 Pinnow
5,021,776 A 6/1991 Anderson et al.
5,941,106 A * 8/1999 Williamson, Jr. .... E05B 15/024 292/144
6,046,558 A 4/2000 Larson et al.
6,401,501 B1 6/2002 Kajuch et al.
6,411,195 B1 6/2002 Goldman
6,442,983 B1 9/2002 Thomas et al.
6,761,051 B1 * 7/2004 Tsai ..... E05B 47/0012 70/257
6,898,952 B1 5/2005 Lin
7,047,773 B1 * 5/2006 Lin ..... E05B 37/025 70/25
7,782,200 B1 8/2010 Fleischmann
7,880,585 B1 2/2011 Aronson et al.
7,948,359 B2 5/2011 Marcelle et al.
8,225,629 B2 7/2012 Zuraski et al.
8,353,187 B2 1/2013 Woodling
8,453,481 B2 6/2013 Meekma
8,638,227 B2 1/2014 Yuan
8,640,513 B2 2/2014 Goren et al.
8,806,907 B2 8/2014 Kalous et al.
8,850,858 B2 10/2014 Nave
8,902,040 B2 * 12/2014 Greisen ..... G07C 9/00571 340/5.1
9,000,917 B1 4/2015 Meyers
9,059,576 B2 6/2015 Isaacks et al.
9,109,379 B1 8/2015 Ranchod
9,121,199 B2 9/2015 Li
9,540,845 B1 1/2017 Yang
9,556,651 B1 1/2017 Cabral Herrera
9,619,953 B2 * 4/2017 Ranchod ..... G07C 9/00309
9,728,022 B2 * 8/2017 Gengler ..... G07C 9/00174
9,747,739 B2 * 8/2017 Gengler ..... G07C 9/00571
9,784,016 B1 * 10/2017 Cabral Herrera ... E05B 47/0012
9,996,999 B2 * 6/2018 Conrad ..... G07C 9/00309
10,428,557 B2 * 10/2019 Niroomand ..... G07C 9/00119
2006/0185404 A1 * 8/2006 Hansen ..... E05B 9/084 70/38 A
2007/0290790 A1 * 12/2007 Miller ..... G07C 9/00817 340/5.22
2008/0011026 A1 * 1/2008 Huang ..... E05B 35/105 70/21
2009/0299777 A1 12/2009 Silberman
2010/0300163 A1 12/2010 Loughlin et al.
2011/0016931 A1 * 1/2011 McDaid ..... E05B 37/10 70/25
2011/0088438 A1 * 4/2011 Chen ..... E05B 47/0009 70/278.7
2012/0066107 A1 * 3/2012 Grajetzki ..... G06Q 20/04 705/35
2013/0043973 A1 * 2/2013 Greisen ..... G07C 9/00571 340/5.51
2013/0120110 A1 * 5/2013 Kalous ..... G05B 1/01 340/5.54
2013/0255335 A1 10/2013 Jonely
2014/0118107 A1 * 5/2014 Almomani ..... G07C 9/00309 340/5.22
2014/0250954 A1 9/2014 Buzhardt
2015/0221152 A1 * 8/2015 Andersen ..... G07C 9/00309 340/5.22
2015/0292244 A1 * 10/2015 Beatty ..... E05B 47/0012 70/20
2016/0042581 A1 * 2/2016 Ku ..... G07C 9/00309 340/5.61
2016/0140787 A1 * 5/2016 Hsueh ..... G07C 9/00563 340/5.61
2017/0009491 A1 1/2017 Nguyen et al.
2017/0102846 A1 * 4/2017 Ebler ..... A61M 1/3626
2017/0169637 A1 * 6/2017 Lai ..... E05B 17/226
2017/0244811 A1 * 8/2017 McKenzie ..... H04W 76/14
2017/0370127 A1 * 12/2017 Huang ..... E05B 17/06
2018/0016812 A1 * 1/2018 Sanford ..... E05B 37/0024

FOREIGN PATENT DOCUMENTS

GB 2182975 5/1987
KR 20080001597 6/2008
WO WO-2013049533 A1 * 4/2013 ..... E05B 67/00

OTHER PUBLICATIONS

CodeLocks Americas CL2200 Electronic Surface Deadbolt, http://www.codelocks.us/cl2000/cl2200-electronic-surface-deadbolt.html, printed Oct. 30, 2015 (2 pages).
Kwikset Electronic Locks Keyless Entry & Combination Deadbolts, http://www.kwikset.com/smartsecurity/electronic-locks.aspx, printed Oct. 30, 2015 (2 pages).
1500eXD/1500eXDPNK dialSpeed Instructions, www.masterlock.com (1 page).
KitLock Coded Locker Solutions KL1200 (1 page).
International Search Report dated Feb. 7, 2017 in international patent application No. PCT/CN2016/108711 (8 pages).

* cited by examiner

ELECTRONIC COMBINATION LOCK WITH DIFFERENT LEVELS OF ACCESS CONTROL

CROSS REFERENCE TO RELATED PATENT APPLICATION

This application is a Continuation-In-Part application of U.S. patent application Ser. No. 15/700,502, filed Sep. 11, 2017, which is a Continuation-In-Part application of U.S. patent application Ser. No. 15/351,708, filed Nov. 15, 2016, which claims priority to U.S. Provisional Patent Application No. 62/266,052, filed Dec. 11, 2015, whose entire contents are hereby incorporated by reference.

BACKGROUND OF THE INVENTION

In today's market, there are many electronic locking devices. Some of those locking devices allow a user to use an electronic device to send an electronic signal for unlocking the locking device.

SUMMARY OF THE INVENTION

The present invention provides an electronic combination lock that can be unlocked by an electronic-lock mechanism which responds to a key-pad entry via a touch pad on the electronic combination lock or via a wireless signal conveyed from a detached electronic device such as a mobile phone, or by a key-lock mechanism. According to some embodiments of the present invention, the access of a combination lock can have different levels. For example, the homeowner can allow a temporary user to have limited access to the homeowner's property by issuing a temporary code. Once such temporary code has been used for the designated number of times, the code will become invalidated. The electronic combination lock has a memory to store one or more preset codes for various access levels, including a first level, a second level and a third level. The electronic combination lock can be unlocked and the preset codes stored in the combination lock can also be changed by a detached electronic device which is configured to communicate with the combination lock with wireless signals. Thus, the first aspect of the present invention provides an electronic combination lock operable in a locked mode, an opened mode and a reset mode, the combination lock comprising:

an electronic circuit configured to communicate with a mobile device via wireless signals, the wireless signals indicative of a combination code for operating the electronic combination lock at one of a plurality of access levels, the plurality of access levels comprising at least a first level and a second level;

a touch panel arranged to receive information indicative of a keypad entry code for operating the combination lock independently of the mobile device;

a non-transitory memory configured to store a plurality of preset codes, the plurality of preset codes comprising at least a present code for the first level and a preset code for the second level;

a processor configured to compare the plurality of preset codes with the keypad entry code from the touch panel or a received combination code from the mobile device and to allow access of the combination lock if the keypad entry code or the received combination code is indicative of one of the preset codes, wherein the preset code for the second level is indicative of a permission to access the combination lock, and the preset code for the first level is indicative of a permission to access the combination lock an unlimited number of times and a permission to change the preset code for all access levels.

According to an embodiment of the present invention, the combination code for the second level is further indicative of a permission to access the combination lock an unlimited number of access times, and wherein the plurality of access levels further comprise a third level, wherein the combination code for the third access level is indicative of a permission to access the combination lock a limited number of access times.

According to an embodiment of the present invention, the mobile device comprises a display configured with an application icon configured for communication with the combination lock via the wireless signals when the application icon is activated.

According to an embodiment of the present invention, the display of the mobile device is further configured with a deactivation icon associated only with the preset code for the first level, and when the deactivation icon is activated, the wireless signals are arranged to cause a disablement of the touch panel in receiving the information indicative of the keypad entry code.

According to an embodiment of the present invention, the display is also configured with a re-activation icon associated only with the preset code for the first level, and when the re-activation icon is activated, the wireless signals are arranged to terminate the disablement of the touch panel, allowing the touch panel to receive information indicative of the keypad entry.

According to an embodiment of the present invention, the combination lock further comprises:

a lock body having a first body side, an opposing body side and an inner case located between the first body side and the second body side, the inner case having a shackle channel;

a shackle having a long leg and a short leg, the long leg arranged for placement in the shack channel, the short leg located on the first body side of the lock body when the combination lock is operated in the locked mode;

a controlling latch having a latch hole, the controlling latch arranged to engage with the long leg of the shackle when the combination lock is operated in the locked mode, preventing the shackle from moving in a first direction toward the first body side of the lock body to unlock the combination lock;

a solenoid having a retractable shaft, wherein when the combination lock is operated in the locked mode, the shaft is received in the latch hole, securing the controlling latch in engagement with the long leg of the shackle; and a blocking plate engageable with the short leg of the shackle when the combination lock is operated in the locked mode.

According to an embodiment of the present invention, the blocking plate comprises a driving pin, the blocking plate locatable in a first plate position and a second plate position, said combination lock further comprising a key-lock mechanism configured to unlock the combination lock independently of the keypad entry code and the mobile device when the lock is operated in the locked mode, the key-lock mechanism comprising:

a cylinder having a first cylinder end and an opposing second cylinder end, the second cylinder send arranged to receive a key for operating the combination lock;

a rotatable cam having a first segment and a second segment, the second segment engaged with the first cylinder end of the cylinder for rotation together, the first segment having a pin slot arranged to receive the driving pin of the blocking plate;

a fixed cam fixedly disposed in the lock body near the first body side, the fixed cam having a first portion and a second portion, the second portion having an opening dimensioned to receive the first segment of the rotatable cam with the driving pin of the blocking plate received in the pin slot of the rotatable cam, the first portion arranged to engage with the blocking plate to receive the short leg of the shackle when the blocking plate is located at the first plate position.

According to an embodiment of the present invention, when the key is received into the second cylinder end, the cylinder can be caused to rotate along with the rotatable cam, and the pin slot in the rotatable cam is arranged to move the driving pin of the blocking plate in a second direction opposite to the first direction so as to shift the blocking plate from the first plate position to the second plate position, and wherein when the blocking plate is located in the second plate position, the shackle can be rotated relative to the shackle channel to change the combination lock from the locked mode to the opened mode.

According to an embodiment of the present invention, the blocking plate further comprises a deactivating cutout positioned in relationship to the driving pin, said combination lock further comprising:

a locking latch operable between a blocking position and a releasing position, the locking latch having a latch edge and an activating hole, wherein when the locking latch is positioned in the blocking position, the latch edge is engaged with the deactivating cutout of the blocking plate, preventing the blocking plate from shifting from the first plate position to the second plate position, and wherein when the locking latch is positioned in the releasing position, the latch edge is spaced from the deactivating cutout so as to allow the blocking plate to shift from the first plate position to the second plate position, and wherein when the controlling latch is engaged with the long leg of the shackle to maintain the combination lock in the locked mode, the shaft of the solenoid is also engaged in the activating hole of the locking latch so as to keep the locking latch in the releasing position.

According to an embodiment of the present invention, when the combination lock is operated in the locked mode, the shaft of the solenoid can be caused to retract from the latch hole of the controlling latch so as to allow the long leg of the shackle to move in the first direction to unlock the combination lock.

According to an embodiment of the present invention, when the keypad entry code or the received combination code is indicative of one of the preset codes as determined by the processor, the shaft of the solenoid is caused to retract from the latch hole of the controlling latch.

According to an embodiment of the present invention, the key-lock mechanism further comprises a first spring arranged to urge the locking latch to move toward the deactivating cutout of the blocking plate, and wherein when the combination lock is operated in the locked mode, the shaft of the solenoid can be caused to disengage from the activating hole of the locking hole, and the latch plate is caused to move from the releasing position to the blocking position, preventing the blocking plate from shifting from the first plate position to the second plate position for unlocking the combination lock.

According to an embodiment of the present invention, the display of the mobile device is further configured with a deactivation icon associated only with the preset code for the first level, and when the deactivation icon is activated, the wireless signals are arranged to cause a disablement of the touch panel in receiving the keypad entry code, and the wireless signals are also arrange to cause the shaft of the solenoid to disengage from the activating hole of the locking latch.

According to an embodiment of the present invention, the locking latch further comprises a deactivating hole positioned in relationship to the activating hole, the combination lock furthering comprising a second spring arranged to urge the controlling latch to move toward the long leg of the shackle, wherein when the locking latch is located in the blocking position, both the deactivating hole of the locking latch and the latch hole of the controlling latch are aligned with the shaft of the solenoid, and the shaft of the solenoid is arranged to engage with both the deactivating hole of the locking latch and the latch hole of the controlling latch so as to prevent the blocking plate from shifting from the first plate position to the second plate position and the long leg of the shackle from moving in the first direction to unlock the combination lock.

According to an embodiment of the present invention, the key-lock mechanism further comprises a rod positioned in relationship to the blocking plate, the rod having a rod slope arranged to contact with the latch edge of the locking latch when the locking edge of the locking latch is positioned in the blocking position, and wherein the display of the mobile device is further configured with a re-activation icon associated only with the preset code for the first level, and when the re-activation icon is activated, the wireless signals are arranged to terminate the disablement of the touch panel in receiving the information indicative of the keypad entry code, and the wireless signals are also arrange to cause the shaft of the solenoid to disengage from both the deactivating hole of the locking latch and the locking hole of the controlling latch, and when the shaft of the solenoid is disengaged from locking hole of the controlling latch, the long leg of the shackle can be caused to move in the first direction to unlock the combination lock so as to allow the short leg to move away from the blocking plate, and when the shaft of the solenoid is disengaged from the deactivating hole of the locking latch, the rod can be caused to move in the second direction so as to disengage the latch edge of the locking latch from the deactivating cutout of the blocking plate.

The second aspect of the present invention provides a mobile device, comprising:

a display configured with an application icon arranged for communications with a combination lock, and an electronic circuit configured to provide wireless signals when the application icon is activated, the wireless signals indicative of a combination code for operating the combination lock at one of a plurality of access levels, the access levels comprising at least a first level and a second level, wherein the combination code for the second level is indicative of a permission to access the combination lock, and the combination code for the first level is indicative of a permission to access the combination lock an unlimited number of times and a permission to change the combination code for all access levels, wherein the combination lock comprises a touch panel arranged to receive information indicative of a keypad entry for operating the combination lock independently of the wireless signals, and wherein the display is further configured with a deactivation icon associated only with the combination code for the first level, and when the deactivation icon is activated, the wireless signals are arranged to cause a disablement of the touch panel in receiving the information indicative of the keypad entry.

According to an embodiment of the present invention, the combination lock further comprises a key-lock mechanism configured to unlock the combination lock by a key independently of the keypad entry and the wireless signals, and wherein when the deactivation icon is activated, the wireless signals are also arranged to cause a disablement of the key-lock mechanism.

According to an embodiment of the present invention, the display is also configured with a re-activation icon associated only with the combination code for the first level, and when the re-activation icon is activated, the wireless signals are arranged to terminate the disablement of the touch panel, allowing the touch panel to receive information indicative of the keypad entry.

According to an embodiment of the present invention, the combination code for the second level is further indicative of a permission to access the combination lock an unlimited number of access times, and wherein the plurality of access levels further comprise a third level, wherein the combination code for the third access level is indicative of a permission to access the combination lock a limited number of access times.

According to an embodiment of the present invention, the key-lock mechanism further comprises a re-activation mechanism to terminate the disablement of the key-lock mechanism independently of the wireless signals.

The present invention will become apparent upon reading the description in conjunction with FIGS. 1 to 55.

DETAILED DESCRIPTION OF THE INVENTION

Figure 1:
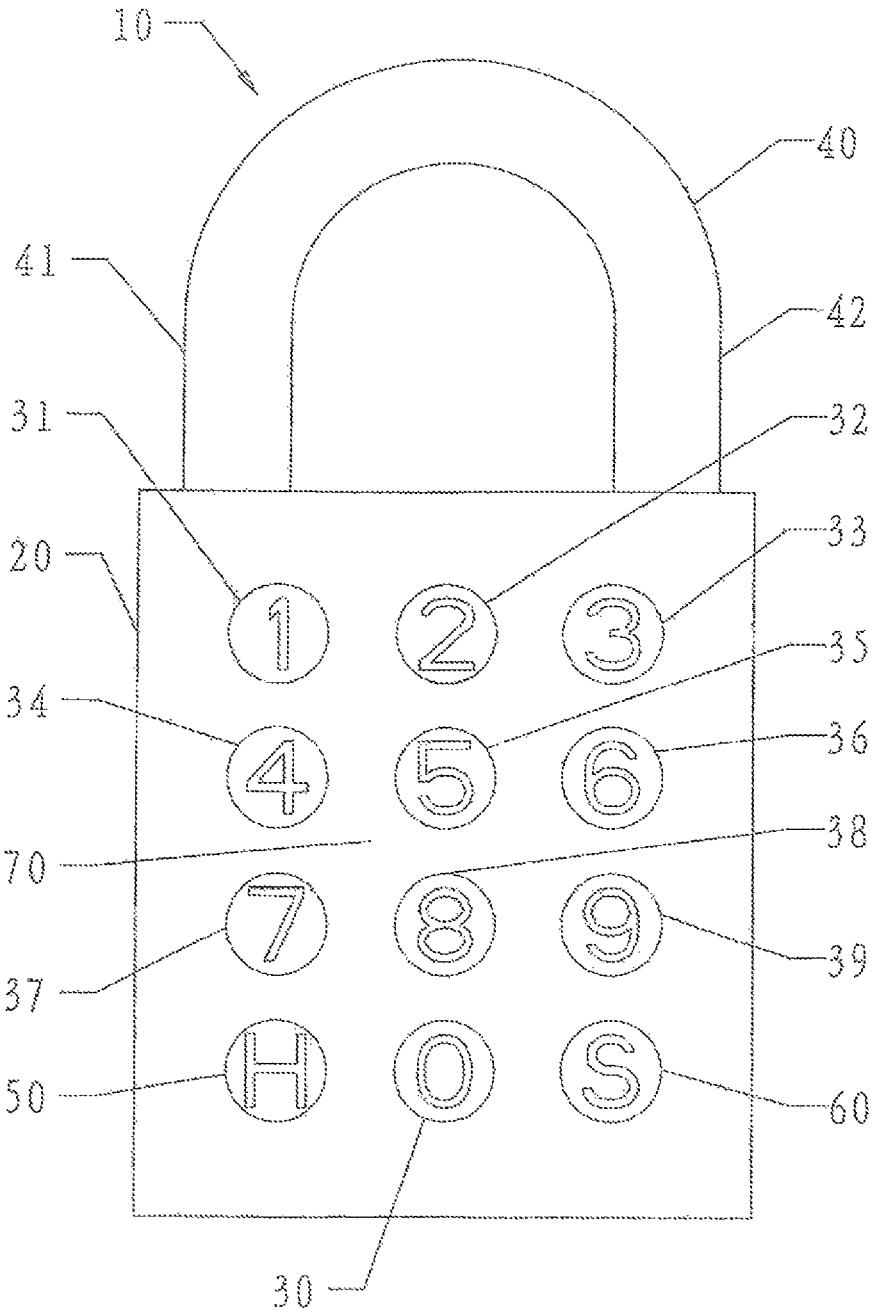
FIG. 1 shows an electronic combination lock, according to an embodiment of the present invention.
Figure 2:
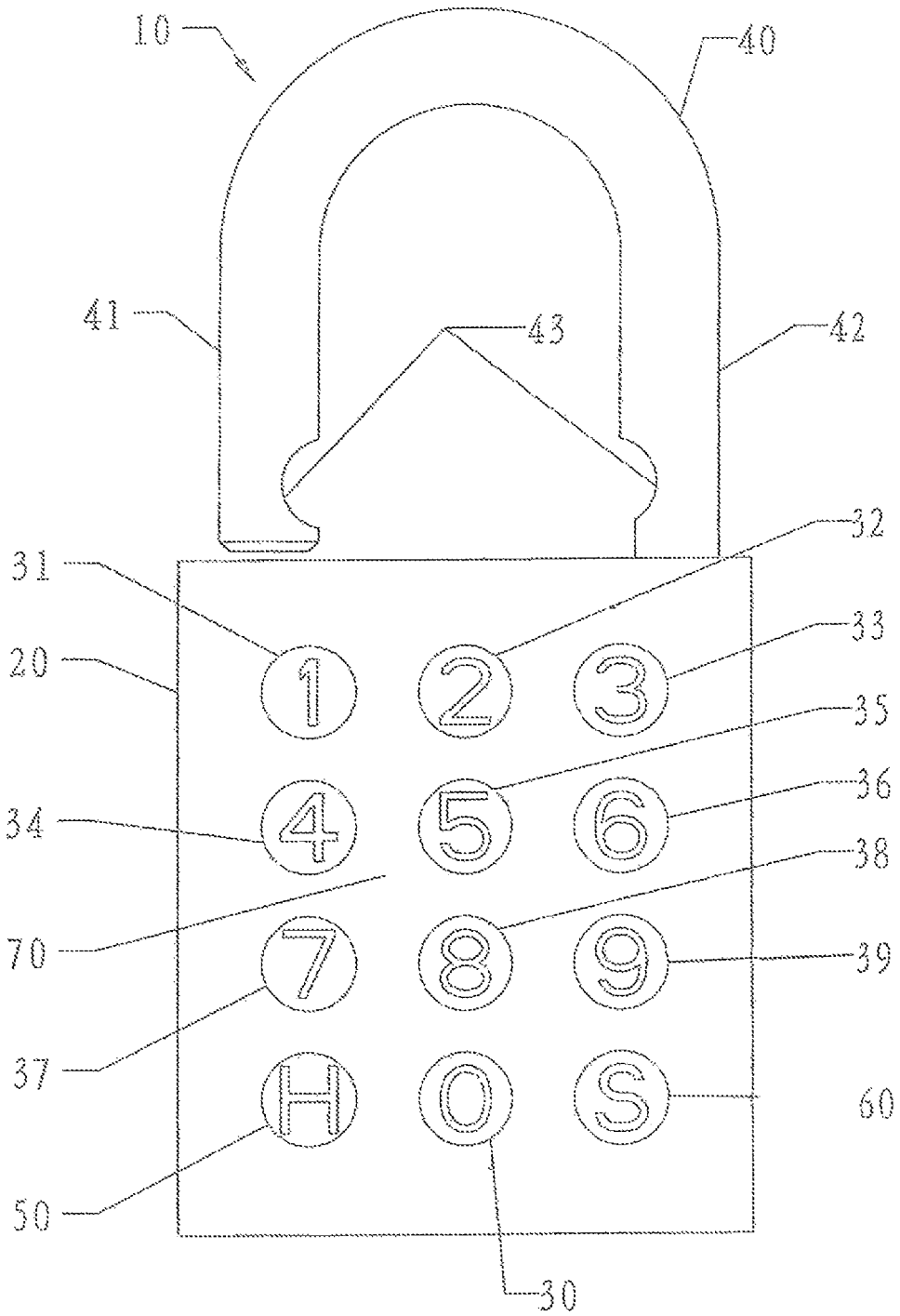
FIG. 2 shows the electronic combination lock in an opened mode as the shackle has been released.

As seen in FIGS. 1-13, the electronic combination lock 10, according to an embodiment of the present invention, has a lock body 20, a shackle 40 and a touch panel 70. The touch panel 70 has a plurality of numerical keys or keypads 30-39, a home button 50 and a reset button 60. The shackle 40 has a short leg 41 and a long leg 42. The lock body 20 has a lock hole 21 dimensioned to receive the short leg 41 and a long-leg channel 22 dimensioned to receive the long leg 42 of shackle 40. The long-leg channel 22 defines a longitudinal axis for rotation. Each of the short leg 41 and the long leg 42 has a cutout 43 as part of the locking mechanism. The locking mechanism includes a locking bolt 80 and a locking ball 180 engaging with the cutout 43 on the short leg 41 and the cutout 43 on the long leg 42 when the combination lock 10 is operated in the locked mode and in the unlocked mode (FIG. 1). The position of locking bolt 80 and locking ball 180 is controlled by a rotatable cam 140. The cam 140 has a bolt slot 144 and a bolt slot 145 positioned such that when the cam 140 is rotated by a certain angle, the locking bolt 80 and the locking ball 180 are allowed to move away from the cutouts 43. As such, the shackle 40 can be pushed upward by a shackle spring 160 to release the short leg 41 of shackle 40 from the lock hole 21 of lock body 20 to operate the combination lock in the opened mode (FIG. 2). The shackle 40 can now be rotated along the long leg 42 as a rotation axis. The cam 140 has a groove 146 (see FIG. 11B) with a groove indent 141 having an engaging relationship with a cam ball 90. The position of the cam ball 90 is controlled by a solenoid 100 having a slug or tip 101 (see FIG. 8). When the combination lock 10 is operated in the locked mode, the tip 101 or solenoid 100 is arranged to push the cam ball 90 against the groove intent 141 such that the cam 140 cannot be rotated to release the shackle 40 as illustrated in FIG. 3A.

Figure 3:
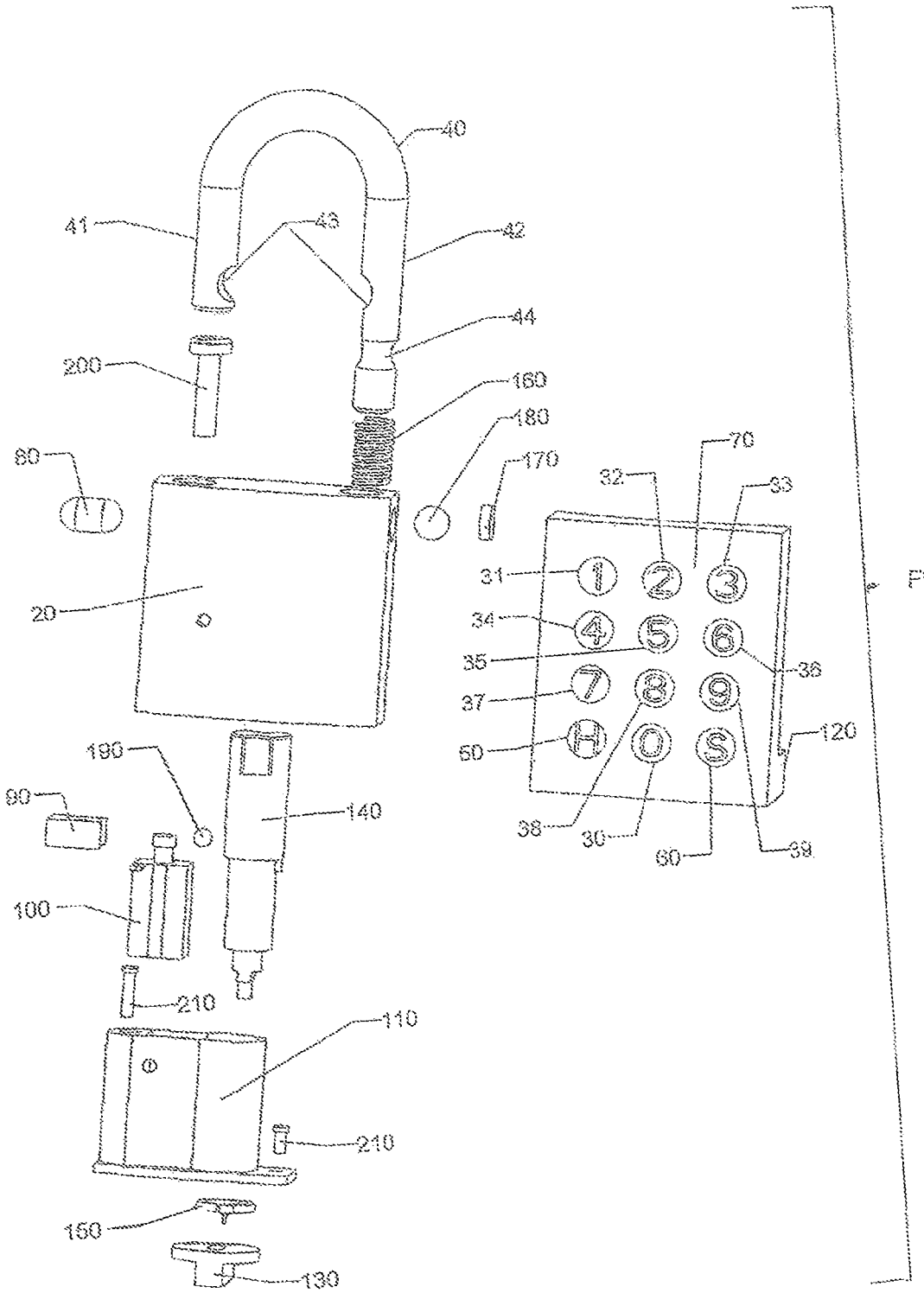
FIG. 3 is an exploded view of the combination lock showing various mechanical components of the lock.
Figure 3A:
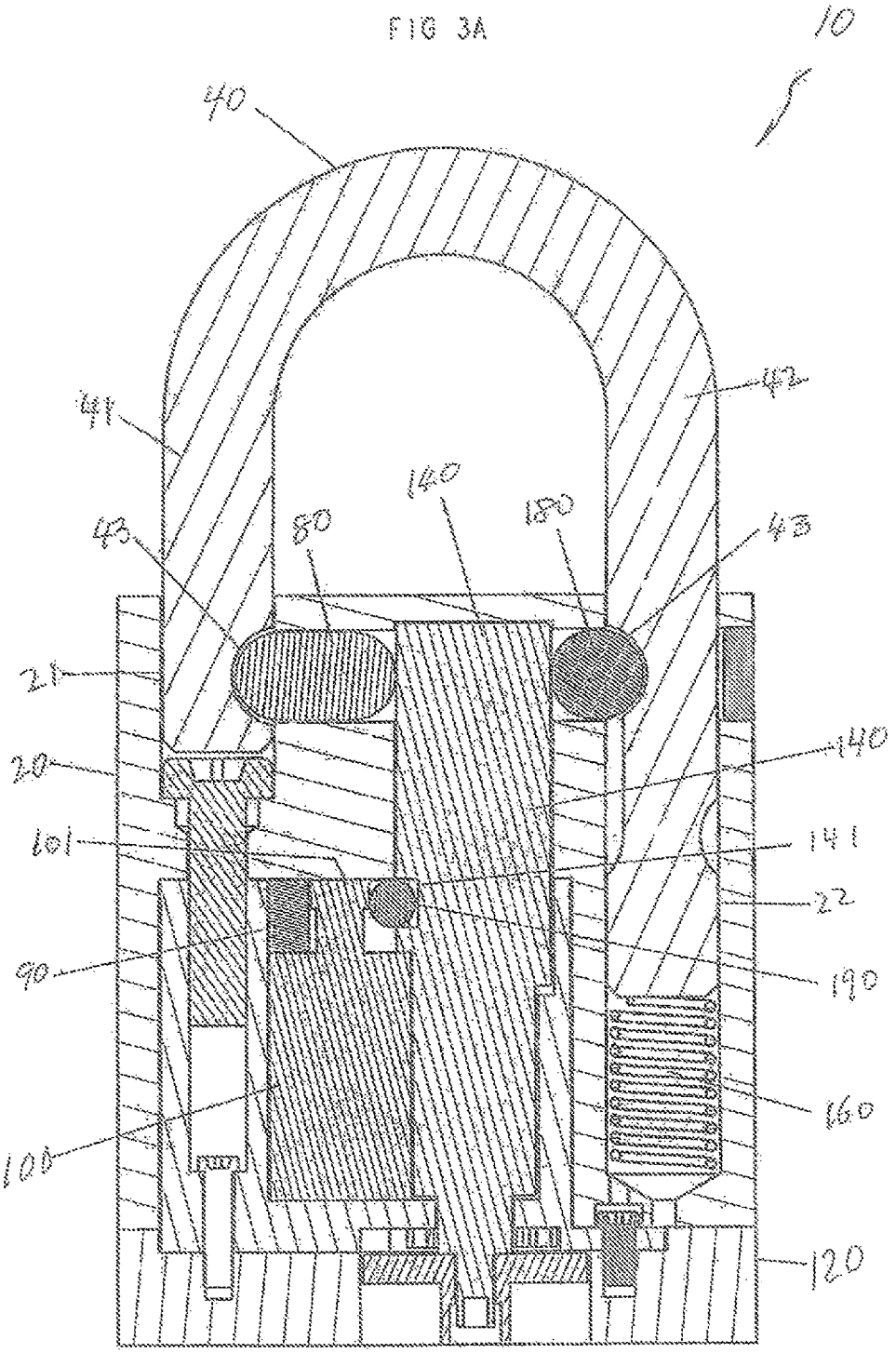
FIG. 3A is a cross sectional view of the combination lock in a locked mode.
Figure 3B:
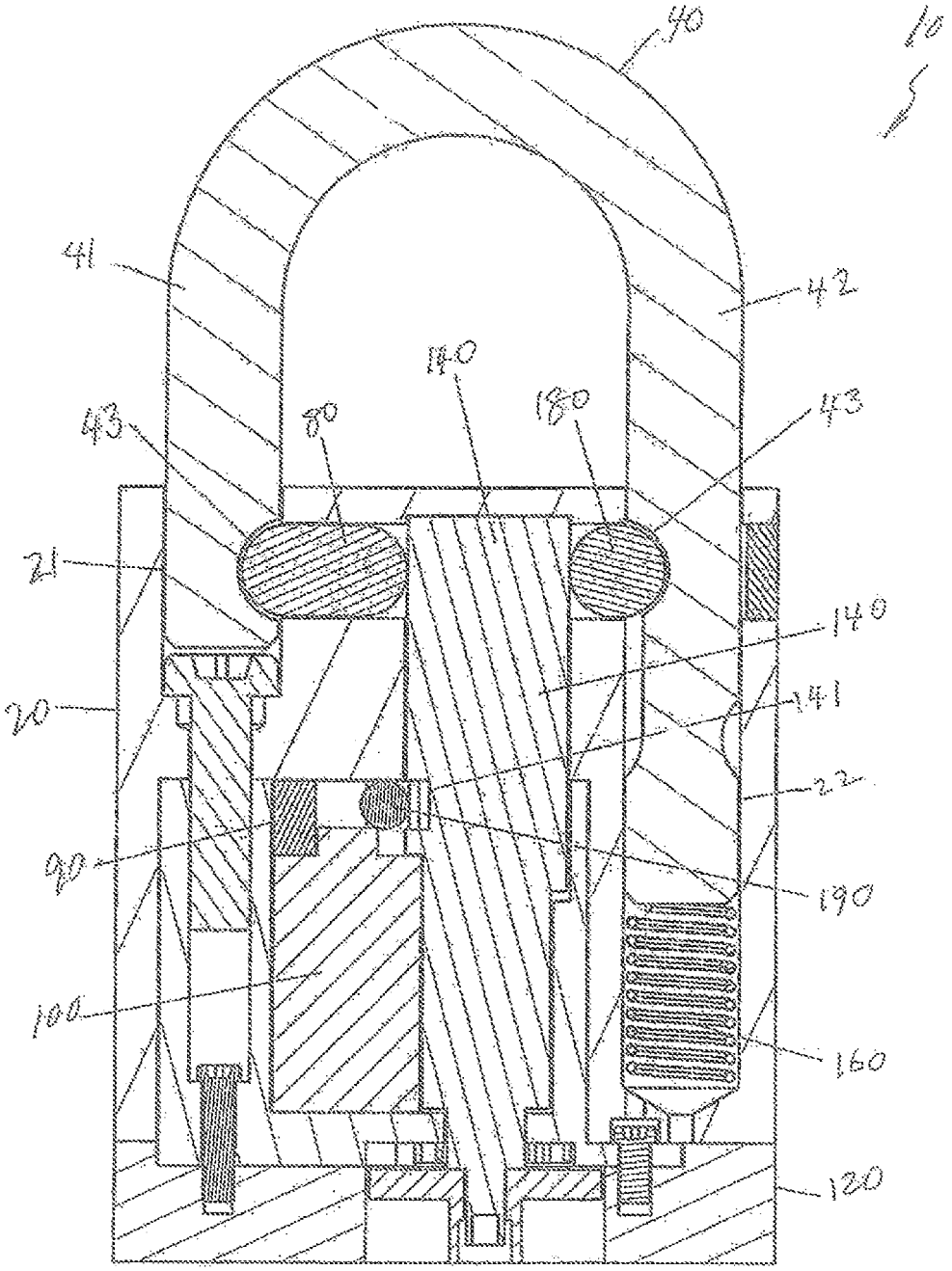
FIG. 3B is a cross sectional view of the combination lock in an unlocked mode.
Figure 4A:
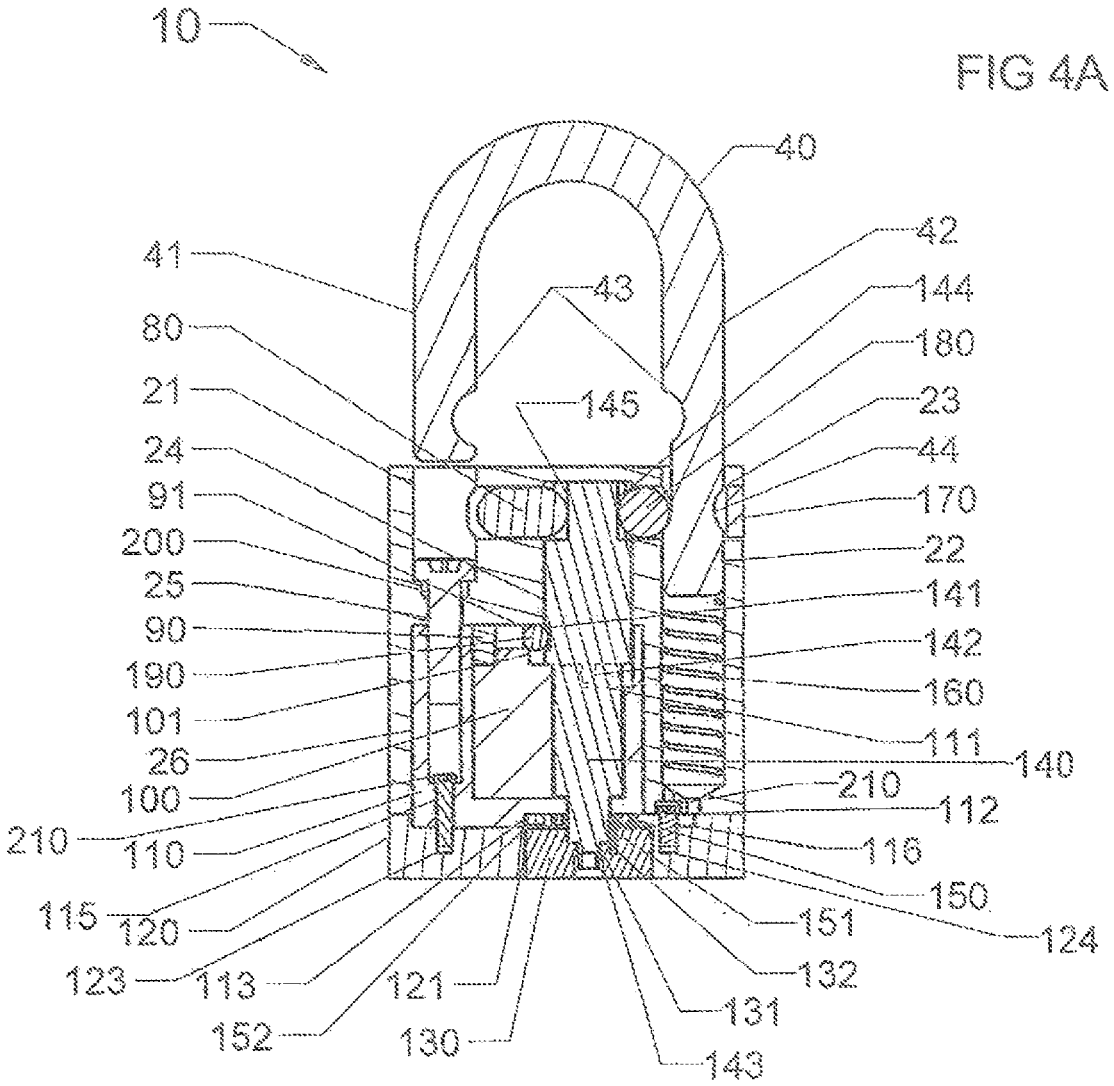
FIG. 4A is a cross sectional view of the combination lock in an opened mode.
Figure 4B:
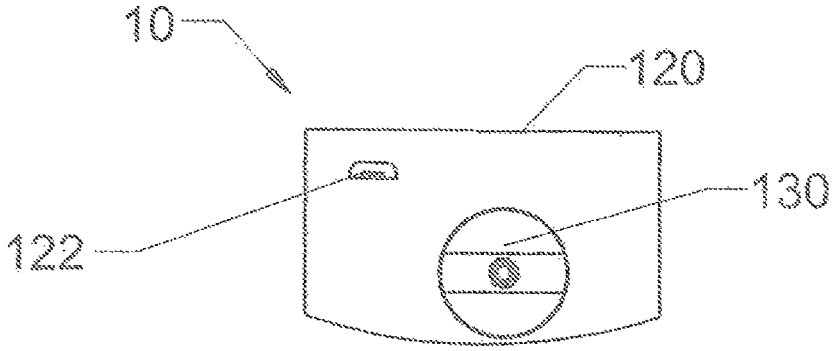
FIG. 4B is a bottom view of the combination lock.
Figure 12:
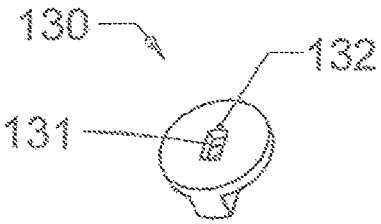
FIG. 12 shows a bottom view of the turn knob.

When a user uses the touch panel 70 to key in the correct combination code using keypads 30-39, the solenoid 100 is energized to cause the tip 101 to move inward toward the solenoid body 102 and the combination lock is in the unlocked mode as illustrated in FIG. 3B. As such, the cam ball 90 can move away from the groove indent 141, allowing the user to rotate the cam 140 to release the shackle 40 to operate the combination lock in the opened mode as illustrated in FIG. 4A. As seen in FIGS. 4A and 4B, the combination lock 10 has a panel base 120 connected to the lock body 20. The panel base 120 has a base support 128 connected to a panel support 129. The panel support 129 is arranged to support the touch panel 70. As seen in FIG. 12, the base support 128 has a base opening 121 to place a turn knob 130. The turn knob 130 has a slot 131 fixedly attached to flat surfaces 143 of the cam 140 such that when the cam ball 90 has moved away from the groove indent 141, the user can use the turn knob 130 to rotate the cam 140 to release the shackle 40 in order to operate the lock 10 in the opened mode.

It should be understood that some of the components of the electronic combination lock 10 are not shown in the drawings as shown in FIGS. 1-30. For example, the electronic combination lock 10 has a non-transitory memory unit to store combination codes; an electronic processor to determine whether a keypad entry by a user matches a stored combination code; an electronic driving circuit to drive the solenoid; a power source or battery to provide electrical power to various electronic and electro-mechanical components and a battery charger. These components are presented in the block diagram of FIG. 31. Furthermore, the touch panel 70 can be any type of touch panel or touchscreen. For illustration purposes only, in the touch panel 70 described herein, the numerical keypad with keys 30-39, the home button 50 and the set button 60 appears on the touch panel 70 only long enough for keypad entry. According to an embodiment of the present invention, the battery, the electronic processor and other electronic circuits are housed in the panel base 120, for example.

As seen in FIG. 4B which shows the bottom view of the combination lock 10, the panel base 120 has a charging slot 122 arranged for charging the battery in the panel base 120.

Figure 5:
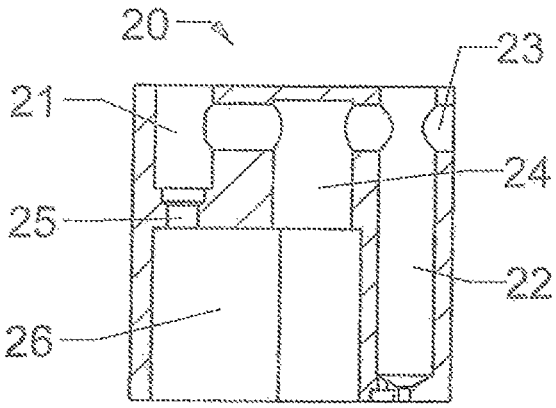
FIG. 5 is a cross sectional view of the lock body.

As seen in FIG. 5, the lock body 20 has a lock hole 21 dimensioned to receive the short leg 41 of shackle 40; a long-leg channel 22 dimensioned to receive a shackle spring 160 and the long leg 42 of shackle 40; a bolt hole 23 for placing the locking bolt 80 and the locking ball 180 inside the lock body 20; a cam hole 24 for placing the cam 140; an open area 26 to receive part of a solenoid base 110; and a screw hole 25 below the lock hole 21 to allow a screw 200 to fasten the lock body 20 to the solenoid base 110.

Figure 6:
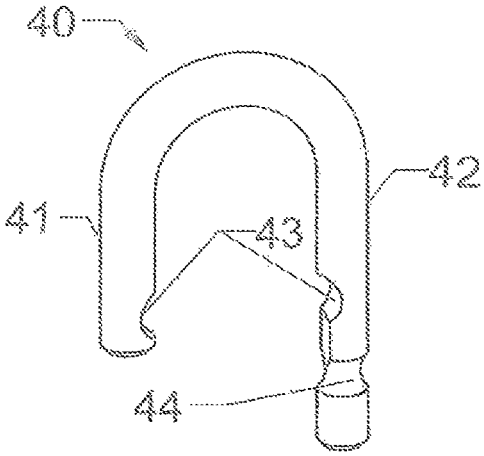
FIG. 6 is an isometric view of the shackle.

As seen in FIG. 6, the shackle 40 also has a retaining groove 44, together with the locking ball 180, arranged to prevent the long leg 42 of shackle 40 from completely moving away from the long-leg channel 22 of lock body 20.

Figure 11A:
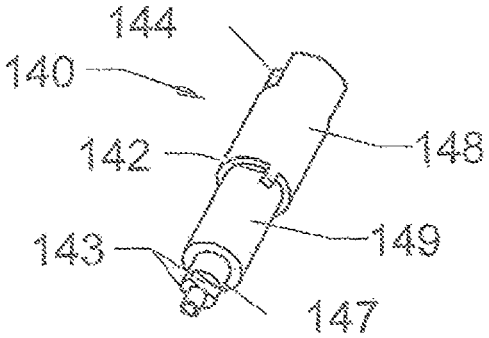
FIGS. 11A and 11B show different views of the cam.
Figure 11B:
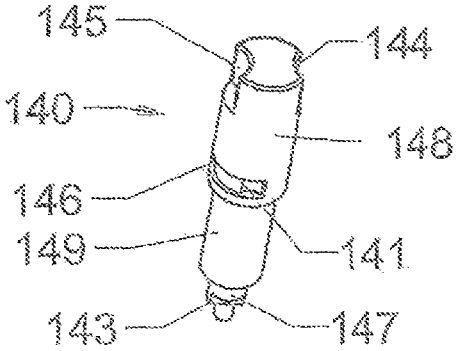

As seen in FIGS. 11A and 11B, the cam 140 has a larger cylindrical body 148 and a smaller cylindrical body 149. The upper part of the larger cylindrical body 148 has a bolt slot 144 and a ball slot 145. The lower part of the larger cylindrical body 148 has a fin 142 extended over the upper part of the smaller cylindrical body 149. The lower part of the smaller cylindrical body 149 has a reduced end 147 with two opposing flat surfaces 143. The lower part of the larger cylindrical body 148 also has a groove 146 and an indent 141 at one end of the groove 146. The groove 146 is used to keep the cam ball 90 on track while the cam 140 is rotated.

Figure 9A:
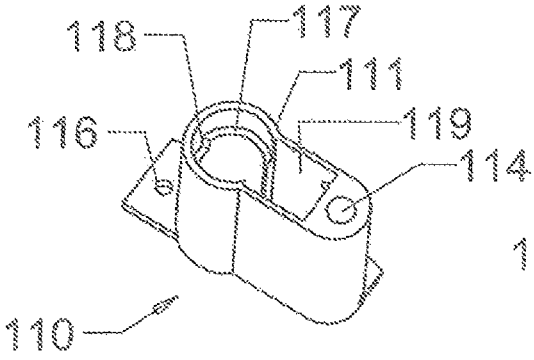
FIG. 9A shows a top view of the solenoid base.

As seen in FIG. 9A, the solenoid base 110 has an outer cylindrical wall 111 and an inner cylindrical wall 117. The an inner diameter of outer cylindrical wall 111 is dimensioned to receive the large cylindrical body 148 of cam 140, whereas the inner diameter of the inner cylindrical wall 117 is dimensioned to receive the smaller cylindrical body 149 of cam 140. The inner wall 117 has an edge 118 arranged to stop the fin 142 of cam 140 in order to limit the rotation of cam 140. The solenoid base 110 also has an opening 119 dimensioned to receive the solenoid 100.

Figure 9B:
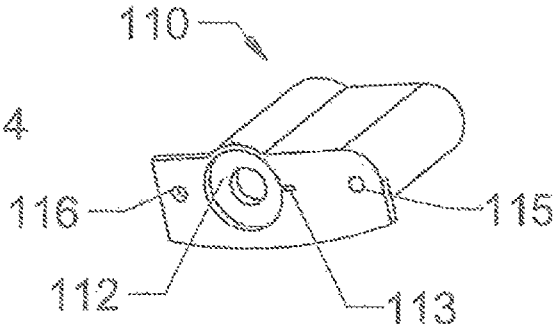
FIG. 9B shows a bottom view of the solenoid base.
Figure 13:
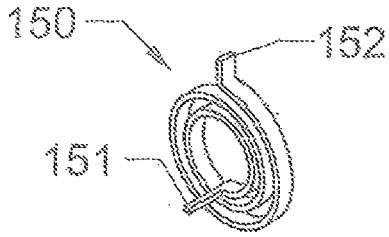
FIG. 13 is an isometric view of the cam spring.
Figure 14A:
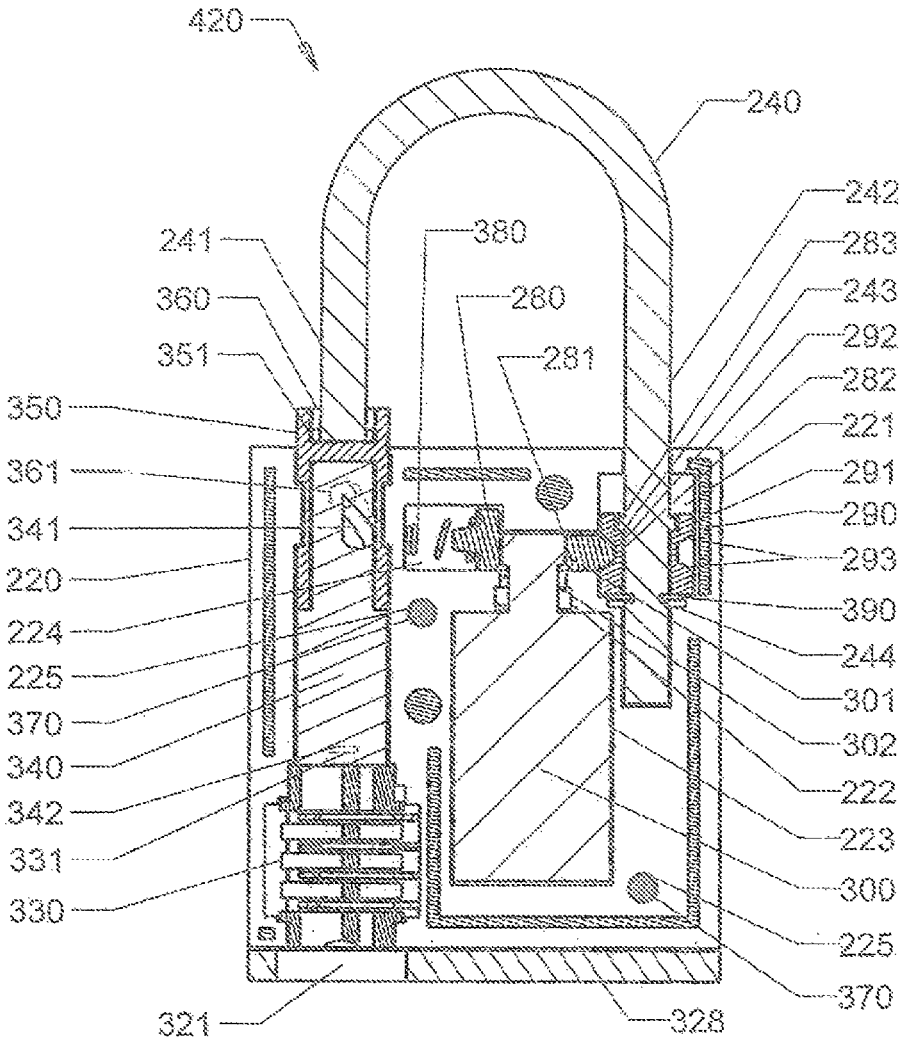
FIG. 14A is a cross sectional view of the combination lock in a locked mode, according to a different embodiment of the present invention.
Figure 14B:
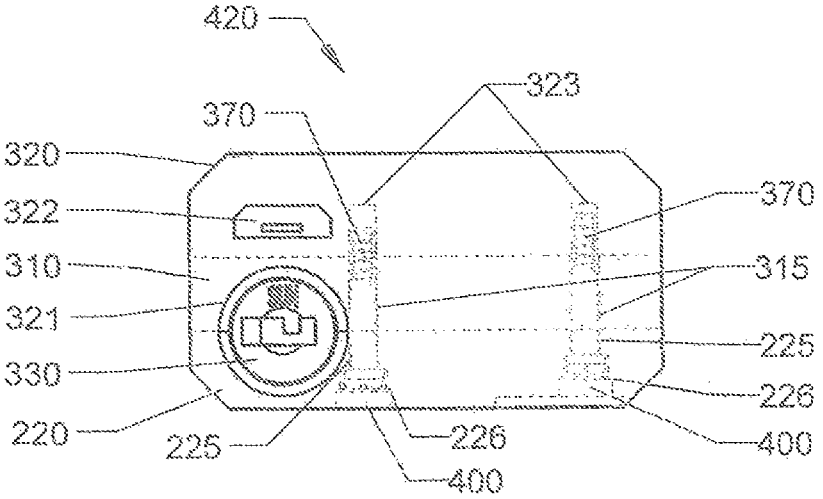
FIG. 14B is a bottom view of the combination lock of FIG. 14A.

As seen in FIGS. 9B and 13, the solenoid base 110 has a base recess 112 to receive a cam spring 150 which has a knob-side tail 151 and a base-side tail 152. In the periphery of the base recess 112 there is a slot 113 arranged to receive the base-side tail 152 of cam spring 150.

Figure 7:
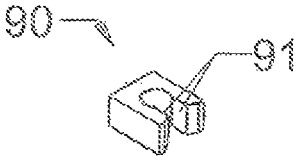
FIG. 7 is an isometric view of the solenoid-tip guide slot.
Figure 8:
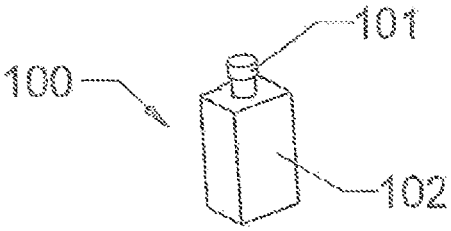
FIG. 8 shows an example of a solenoid.

FIG. 7 shows a solenoid-tip guide 90 positioned on top of solenoid 100. The solenoid-tip guide 90 has an opening 91 dimensioned to receive tip 101 of solenoid 100. The placement of the solenoid guiding unit 90 limits the lateral movement of the cam ball 190 when the tip 101 of solenoid 100 is retrieved inward toward the solenoid body 102 to allow lock 10 to operate in the opened mode.

Figure 10A:
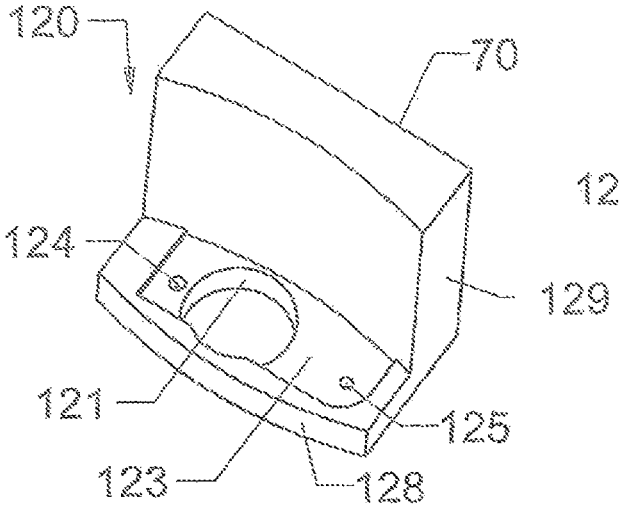
FIG. 10A shows a top view of the panel base.
Figure 10B:
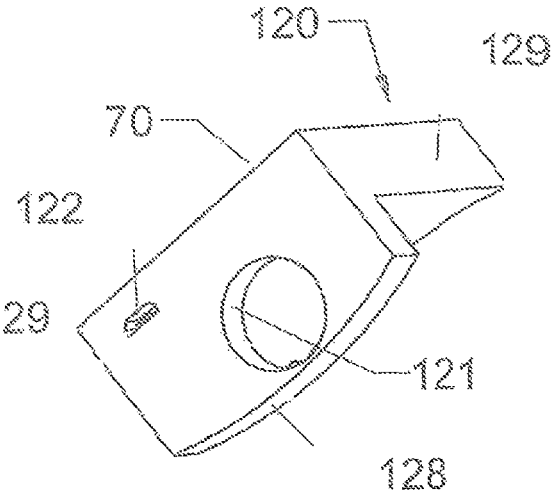
FIG. 10B shows a bottom view of the panel base.

FIGS. 10A and 10B show different views of the panel base 120 which has a panel support 129 attached a base support 128. The panel support 128 is arranged to mount a touch panel 170. As seen in FIG. 10A, the base support 128 has a recessed area 123 dimensioned to receive the base of the solenoid base 110. In the recessed area 123 there are two screw holes 124, 125 arranged for fastening the solenoid base 110 to the panel base 120 with screws 210 (see FIG. 4A). With the solenoid base 110 securely fastened to the panel base 120, the solenoid base 110 can be inserted into the open area 26 of lock body 20 with the lock body 20 located next to panel support 129.

It should be understood that the electrical power provided to the solenoid 100 can be made through electrical contacts in the solenoid base 110 and the panel base 120, for example. The electrical power provided to the touch panel 70, the electronic processor and other electronic circuit components can be made through electrical connectors in the panel base 120, for example. A power source such as a rechargeable battery required for powering the electronic and electromechanical components of the electronic combination lock 10 can be recharged through the charging slot 122 on the panel base 120.

Classification of Users

The electronic combination lock 10, according to an embodiment of the present invention, can be used by a number of users with different access levels. For example, there can be three access levels and the combination lock users can be classified as master users, regular users and temporary users, associated with different combination codes. According to an embodiment of the present invention, the master users have the highest level of access; the regular users have a second level of access and the temporary users have a third level of access.

As disclosed herein, the terms "permanent user" and "regular user" are used interchangeably.

Master User:

There can be one master code or more than one master code. A user with a master code has an unlimited number of access times (that is, an unlimited number of times to unlock the lock) and can use the reset mode 1) to change the master code, 2) to change or disable a temporary code or a permanent code; and 3) to assign the number of access times for the temporary code user.

Permanent or Regular User:

There can be one or more permanent or regular codes. A user with a permanent code has an unlimited number of access times. However, the permanent users cannot use the reset mode, according to one embodiment of the present invention. In another embodiment of the present invention, a permanent code user is allowed to use the reset mode but only to change his/her own code.

Temporary User:

There can be one or more temporary codes. A user with a temporary code has a limited number of access times. A temporary user is not allowed to use the reset mode.

According to an embodiment of the present invention, the use of a code to operate the padlock is described as follows:

Unlocking Procedure by Any User (Master User, Permanent User or Temporary User, with a Valid User Code as Validated by a Code Storage in the Padlock)

1. Touch anywhere on the screen to cause the keypad to appear on the screen.
2. On the keypad, enter a combination code and then press the home-key to set the padlock in the unlocked mode.
3. Manually release the shackle in order to mechanically open the padlock.

In one embodiment, the shackle must be manually released within a predetermined period of time. When the predetermined period of time has expired, the padlock automatically returns to the locked state. If the user wants to open the lock again, the user can follow the same procedure.

For demonstration purposes, assuming the padlock is configured to store a total of 9 users. User 1 has the master code, and Users 2-6 are regular users which can have unlimited number of access times. Users 7-9 are temporary users having only a limited number of access times to use a code to access to the lock.

Reset Procedure for Resetting a Master Code (The User Must Have a Master Code as Validated by the Code Storage in the Padlock)

1. Touch anywhere on the screen to cause the keypad to appear on the screen.
2. On the keypad, enter a master code and then press the home-key to set the padlock in the unlocked mode.
3. Press the set button and then the home-key to enter the "reset mode"
4. Enter the same master code the then press the home-key (optional in one embodiment).
5. Press 1 to select the type of code to be changed.
6. Enter a new (master) code and then press the home-key to set the padlock in the lock mode.

Reset Procedure for Resetting a Permanent Code (The User Must Have a Master Code as Validated by the Code Storage in the Padlock)

1. Touch anywhere on the screen to cause the keypad to appear on the screen.

2. On the keypad, enter a master code and then press the home-key to set the padlock in the unlocked mode.
3. Press the set button and then the home-key to enter the "reset mode".
4. Enter the same master code and then press the home-key (optional in one embodiment)
5. Press 2-6 to select the type of code to be changed.
6. Enter a new (permanent) code and then press the home-key to set the padlock in the lock mode.

Reset Procedure for Resetting a Temporary Code (The User Must Have a Master Code as Validated by the Code Storage in the Padlock)

1. Touch anywhere on the screen to cause the keypad to appear on the screen.
2. On the keypad, enter a master code and then press the home-key to set the padlock in the unlocked mode.
3. Press the set button and then the home-key to enter the "reset mode".
4. Enter the same master code and then press the home-key (optional in one embodiment).
5. Press 7-9 to select the type of code to be changed.
6. Enter a new (permanent) code and then press the home-key.
7. Enter a number between 1 and 9 to set the number of access times and then press the home-key to set the padlock in the locked mode.

Reset Procedure for Resetting a Permanent Code by the Permanent User (The User Must Have a Permanent Code as Validated by the Code Storage in the Padlock)

1. Touch anywhere on the screen to cause the keypad to appear on the screen.
2. On the keypad, enter a master code and then press the home-key to set the padlock in the unlock mode.
3. Press the set button and then the home-key to enter the "reset mode".
4. Enter the same permanent code and then press the home-key (optional in one embodiment).
5. Enter a new (permanent) code and then press the home-key to set the padlock in the lock mode.

Unlocking and Locking the Combination Lock

When the user wants to operate the electronic combination lock 10 in the opened mode, the user can touch the panel 70 to cause the keypads 30-39, home button 50, and set button 60 to be displayed on the panel. The user can type in a predetermined combination code and then press the home button 50. The electrical power is transferred to the solenoid 100 in a short period of time, about 10 seconds, for example. As the solenoid 100 is activated, the tip 101 of the solenoid 100 moves downward toward the solenoid body 102. As the tip 101 of the solenoid 100 moves downward, the cam ball 190 is able to move away from the groove indent 141 in groove 146 of cam 140. Because the cam 140 is fixedly attached to the turn knob 130, the cam 140 can be rotated by turning the turn knob 130 in order to release the shackle 40. As the cam 140 turns away from its locking position, the locking bolt 80 and locking ball 180 can move into the bolt slot 144 and the ball slot 145. As such, the locking bolt 80 and locking ball 180 are disengaged from the cutouts 43 on the short leg 41 and the long leg 42 of shackle 40. The shackle 40 is now allowed to move upward under the urging force of the shackle spring 160 to release the short leg 41 from the lock hole 21 of lock body 20.

According to some embodiments of the present invention, after the user keys in the correct combination code, there is a period of 10 seconds or so to allow the solenoid to acquire sufficient electrical power in order to attract the tip 101 of solenoid 100 into the downward position. The cam ball 190 is now allowed to move away from the groove 141 indent of cam 140 and the user can now turn the turn knob 130 and the cam 140 to open the lock. With the urge of the shackle spring 160, the shackle 40 moves upward until the locking ball 180 moves into the retaining groove 44 of shackle 40. The groove 44 is arranged to prevent the long leg 42 of shackle 40 from completely moving away from the long-leg channel 22 of lock body 20. After about 10 seconds, the electrical power to the solenoid 100 can be cut off so as to allow the tip 101 of solenoid 100 to move upward. It should be noted that, although the lock 10 is in the opened position, the cam ball 190 is still located on the track 146 of cam 140.

To return the lock 10 to the locked mode, the user simply pushes the shackle 40 downward and the cam 140 is caused to rotate back to its locking position by a cam spring 150 which has a knob-side tail 151 lodged in the spring-tail slot 132 on turn knob 130 and a base-side tail 152 lodged in the spring-tail slot 113 on solenoid base 110 (see FIG. 12). The locking bolt 80 and the locking ball 180 are pushed by the cam 140 into the cutouts 43 of the shackle 40. The cam ball 190 is also caused to move back to the groove indent 141 of cam 140, preventing the cam 140 from rotation relative to the lock body 20.

The solenoid base 110 has a threaded-hole 114 which allows a screw 200 to be fastened through the hole 25 on lock body 20. Once the screw 200 is fastened, the solenoid base 110 cannot be removed from the lock 10. The panel base 120 has two screws holes 124 and 125 which allow screws 210 to be fastened via holes 115 and 116 on solenoid base 110. As such, the solenoid-base 110 and the panel-base 120 are securely fastened to the lock body 20. The panel base 120 also has an opening 121 to allow the user to touch the knob 130. The panel base 120 also has a charging slot 122 to allow the user to charge the battery embedded in the panel base 120 if needed.

As seen in FIG. 3, the combination lock 10 has a sealing plug 170 dimensioned for insertion into the lock body 20 to conceal the bolt hole 23 of the lock body 20.

User Instruction to Unlock the Padlock

1. Touch the panel.
2. Key in a combination code (or old master code, or any preset User Code) and then press the home key.
3. Turn knob clockwise to release the shackle.
4. To lock the lock, simply push the shackle back to the lock position and the lock will lock itself automatically.

Resetting Master Code for USER 1 (Master User Reset Mode)

When the user wants to set a new Master code for the electronic combination padlock 10, the user can touch the touch panel 70 to cause the keypads 30-39, the home button 50, and the set button 60 to display on the panel. The user can now input a preset combination code (or existing Master code) and press the home key 50. The user can then press the set button 60 and then press the home key 50 again. The user can then press digit 1 (keypad 31) in order to set a new master code. After inputting the new master code by pressing numerical keys 30-39, the user must press the home button 50. The lock can now be unlocked with the new master code which must have at least 4 digits but can have 15 digits.

Resetting Permanent User Code for USERS 2-6 with Unlimited Access Time (Permanent User Reset Mode):

When the Master user wants to set a permanent code for the electronic combination padlock 10, the user can touch the touch panel 70 to cause the keypads 30-39, the home button 50, and the set button 60 to display on the panel. The user can input a preset combination code (or existing Master code) and press the home button 50. The user can then press the set button 60 and then the home button 50 again. The user can press one of digits 2-6 (keypads 32-36) in order to set the user code for the selected user among users 2-6. After inputting the new user code for the selected user by pressing numeral keys 30-39, the user must press the home key 50. The lock can now be unlocked with the new permanent user code which must have at least 4 digits but can have 15 digits.

Reset Temporary User Code for USERS 7-9 with Limited Access Time (Temporary User Reset Mode):

When the Master user wants to set the temporary code for the electronic combination padlock 10, the user can touch the panel 70 to cause the keypads 30-39, the home button 50 and the set button 60 to display on the panel. The user can input a preset combination code (or existing Master code) and press the home button 50. The user can then press the set button 60 and then the home button 50 again. The user can press one of the numerical keys 7-9 (keypads 37-39) in order to set the temporary user code for the selected user among users 7-9. After inputting the new user code for the selected user by pressing numeral keys 30-39, the user must press the home button 50. The new temporary user code must have at least 4 digits but can have 15 digits. The user can select the number 1-9 (31-39) for the number of access times that can be used with this temporary code and then the home button 50. Typically, the access times for the temporary code can range from 1-9. The lock is now set with the temporary user code for a temporary user.

Alternative Embodiment

According to a different embodiment of the present invention, the electronic combination lock includes an overriding key locking mechanism as disclosed in U.S. Pat. No. 7,140,209, which is assigned to The Sun Lock Company, Ltd., the assignee of the current application, and hereby incorporated by reference in its entirety.

Figure 17A:
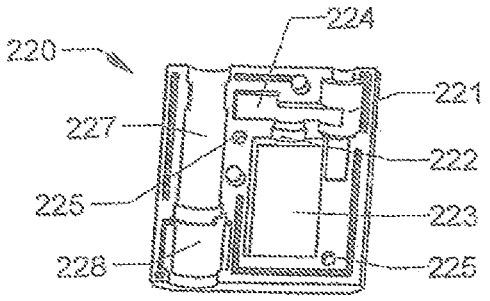
FIGS. 17A and 17B show different views of a first half of the lock body.
Figure 17B:
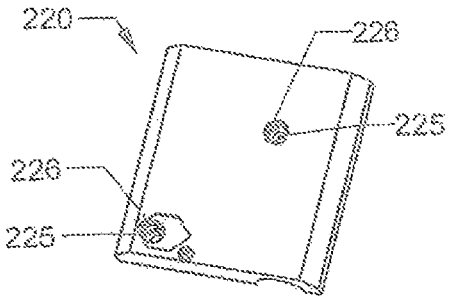
Figure 18:
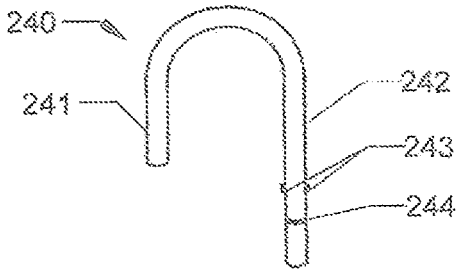
FIG. 18 is an isometric view of the shackle.
Figure 19A:
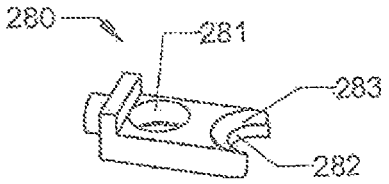
FIGS. 19A and 19B show different views of the latch.
Figure 19B:
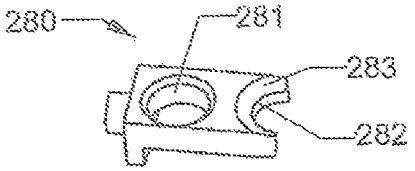
Figure 20A:
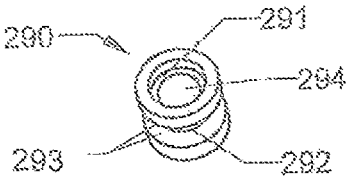
FIGS. 20A and 20B show different views of the locking ring.
Figure 20B:
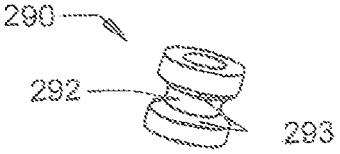
Figure 21:
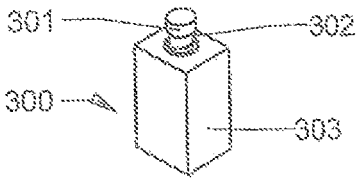
FIG. 21 shows a solenoid.
Figure 22:
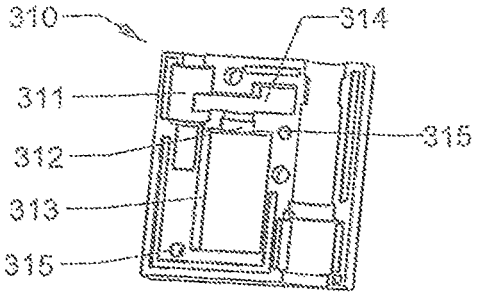
FIG. 22 shows a cross sectional view of a second half of the lock body.
Figure 23A:
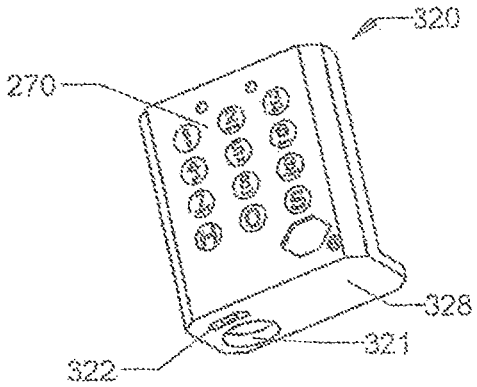
FIGS. 23A and 23B show different view of a panel base.
Figure 23B:
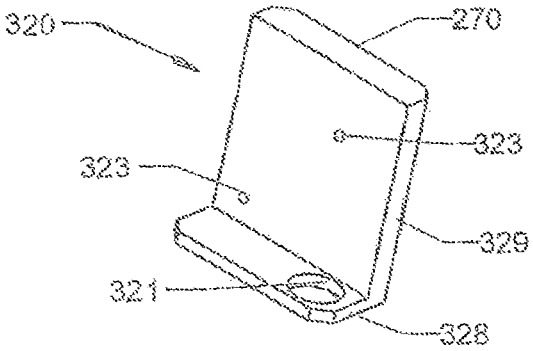
Figure 24:
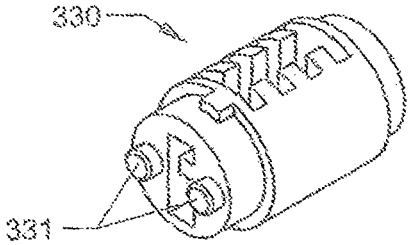
FIG. 24 is an isometric view of the cylinder.
Figure 25:
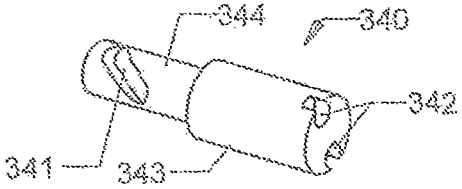
FIG. 25 is an isometric view of the cam.
Figure 26:
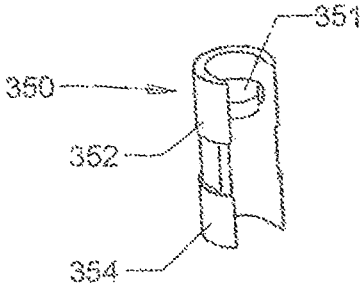
FIG. 26 is an isometric view of the fixed cam.
Figure 27:
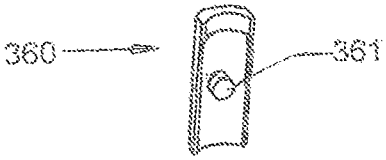
FIG. 27 shows a view of the blocking plate.
Figure 28:
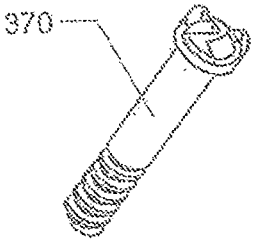
FIG. 28 shows a view of a screw.
Figure 29A:
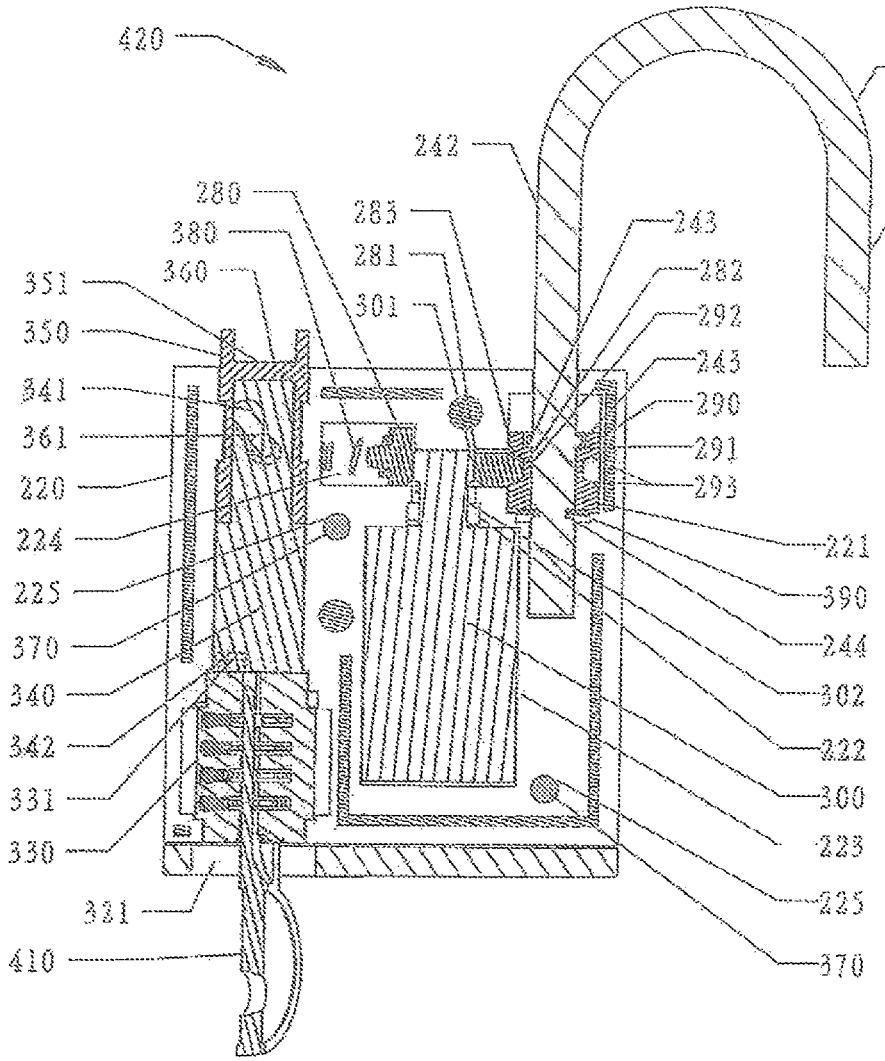
FIG. 29A shows a cross sectional view of the lock opened by a key.
Figure 29B:
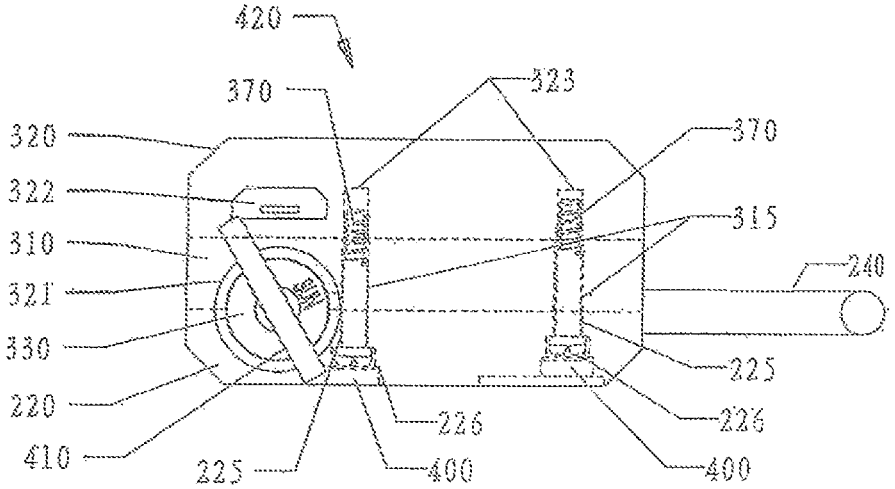
FIG. 29B shows a bottom view of the lock opened by a key.
Figure 30:
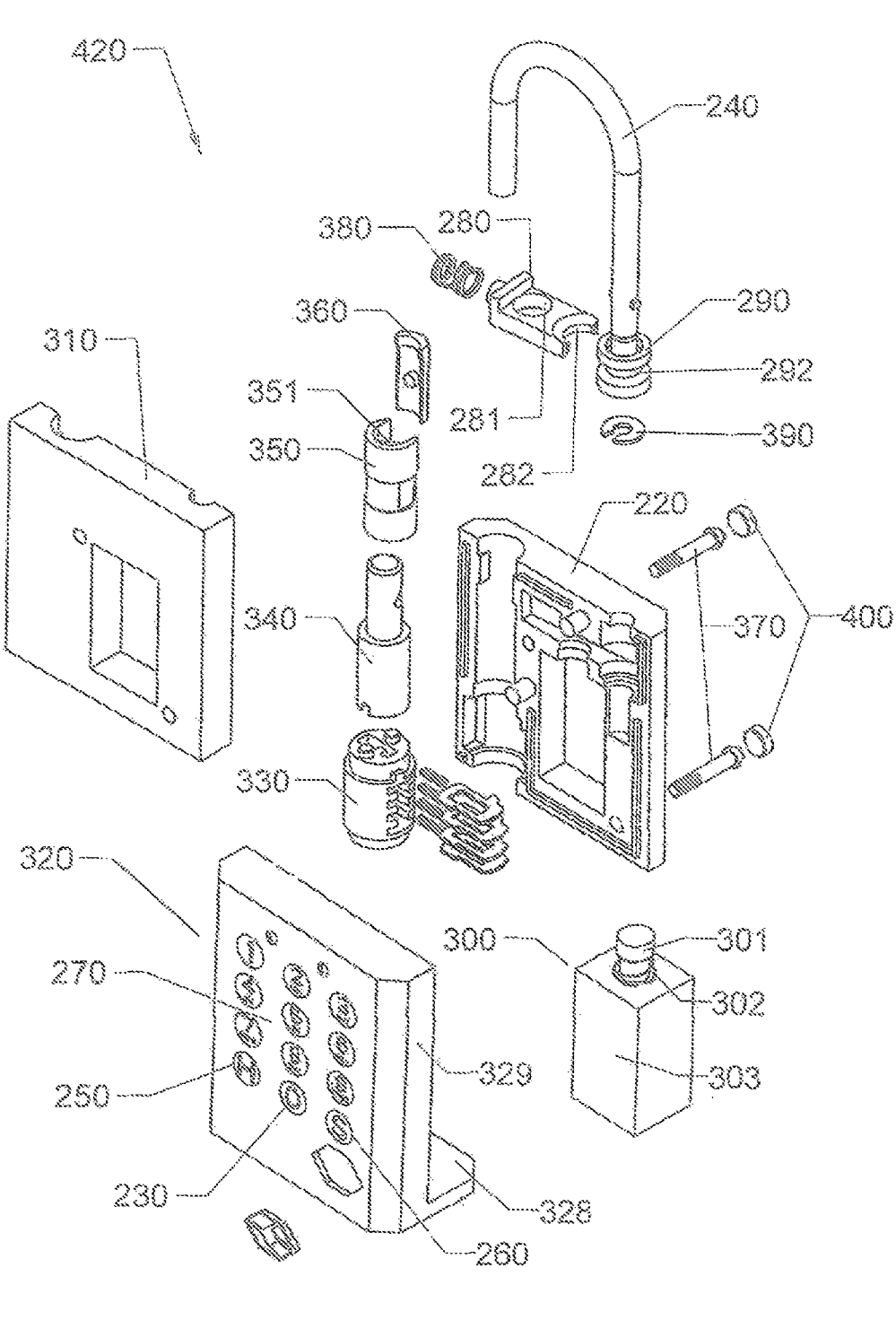
FIG. 30 is an exploded view of the lock showing varies component of the lock.

As seen in FIGS. 14A-30, the electronic combination lock 420 has a lock body 220/310, a shackle 240 and a touch panel 270. The touch panel 270 has a plurality of numerical keys or keypads 230-239, a home button 250 and a reset button 260. The shackle 240 has a short leg 241 and a long leg 242 with a protrusion 243 and a neck 244. The touch panel 270 has a green light 271 and a red light 272. The green light 271 is lit to indicate the input code is correct and the red light 272 is lit to indicate otherwise. As seen in FIGS. 17A and 22, the lock body 220/310 has a lock-ring cutout 221/231 to accommodate a lock ring 290; a solenoid-tip cutout 222/312 dimensioned to receive the tip 301 of a solenoid 300 (see FIG. 21); a solenoid-body cutout 223/313 dimensioned to accommodate the solenoid body 303 of solenoid 300, and a latch cutout 224/314 to house a latch 280. The lock body 220/310 also has screw holes 225/315 to receive screws 270 and two holes 226 to receive screw caps 400 to conceal the screws 370 (see FIG. 14B). The lock body 220/310 has a cam channel 227 for accommodating a rotatable cam 340, a fixed cam 350 and a blocking plate 360. The lock body 220/310 also has a cylinder cutout 228 for placing a cylinder 330 and a long-leg channel 229 dimensioned to receive the end of the long leg 242 of shackle 240. The cylinder 330 has two cylinder pins 331. The rotatable cam 340 has a larger cylindrical body 343 and a smaller body 344. The end of the larger cylindrical body 343 has two receiving slots 342 dimensioned to receive the cylinder pin 331 of cylinder 330. The smaller cylindrical body 344 has a cam slot 341. The latch 280 has a latch hole 281 dimensioned to receive the tip 301 of solenoid 300, and a latch fork 282 arranged to engage with the ring groove 292 of a locking ring 290 which has two groove slopes 293 near the ring groove 292. The latch 280 also has a fork slope 283 on the latch fork 282 arranged to contact with the groove slopes 293 of locking ring 290. The combination lock 420 also has a panel base 320 with a base support 328 and a panel support 329 to support the touch panel 270 (see FIGS. 23A and 23B). The panel base 320 also has screw holes 323 to receive screws 370 for fastening the lock body 222/312 to the panel support 329 on top of the base support 328. The base support 328 has an opening 321 to allow a key 410 to be inserted into the cylinder 330 and a charging slot 322. The fixed cam 350 has a locking hole 351 arranged to receive the short leg 241 of shackle 240. The fixed cam 350 has a gap 355 sufficiently wide to allow the short leg 241 of shackle 240 to move out of the locking hole 351 through the gap 355. The blocking plate 360 is positioned adjacent to the gap 355 of fixed cam 350 and has a width sufficient to block the locking hole 351 so as to prevent the short leg 241 from moving out of the locking hole 351 through the gap 355 while the short leg 241 is located in the locking hole 351. The blocking plate 360 has a locking pin 361 movably engaged with the cam slot 341 of rotatable cam 340.

Locked Mode

As seen in FIGS. 14A, 15, 18, 19, 20A and 20B, the shackle 240 has a short leg 241, a long leg 242, a protrusion 243 and a neck 244. The locking ring 290 has a ring channel 294 dimensioned to receive the long leg 242 of shackle 240 such that the protrusion 243 of shackle 240 is placed on enlarged inner edge 291 of locking ring 20 with a C-clip 390 inserted in the neck 244 of shackle 240. As such, the long leg 242 can only have a rotational movement relative to the locking ring 290. When the lock 420 is operated in the locked mode, the tip 301 of solenoid 300 causes the latch fork 282 to engage with the ring groove 292 of locking ring 290, preventing the shackle 240 from moving upward relative to the lock body 220. With the solenoid 300 being inactive (not energized), the tip 301 is pushed upward by a solenoid spring 302, with the tip 301 of solenoid 300 engaged in the latch hole 281 of latch 280. In this arrangement, the shackle cannot be pulled upward to open the lock. Furthermore, the fixed cam 350 is fixedly attached to lock body 220/310. The fixed cam 350 has a locking hole 351 arranged to receive the short leg 241 of shackle 240. The fixed cam 350 is not an enclosed cylinder such that the short leg 241 can be swung out of locking hole 351 while the long leg 242 remains in the downward position. However, in the locked mode, the blocking plate 360 is positioned relative to the fixed cam 350 to prevent it from being swung out of the locking hole 350.

The Key-Lock Mechanism

As seen in FIGS. 14A, 16, 24, 25, 26, 27 and 30, the cylinder pins 331 of cylinder 330 are inserted into the receiving slots 342 at the end of the larger cylindrical body 343 of rotatable cam 340 so that the cylinder 330 and the rotatable cam 340 can only rotate together by a key. The smaller cylindrical body 344 of rotatable cam 340 has a cam slot 341 to receive the locking pin 361 of blocking plate 360. If an incorrect key is used to unlock the padlock 420, the cylinder 330 and the rotatable cam 340 cannot be rotated. As the locking pin 361 of blocking plate 360 is engaged in the cam slot 341 of rotatable cam 340, the blocking plate 360 cannot move downward. As such, the short leg 241 of shackle 240 is prevented from being swung out of the locking hole 351 of fixed cam 350.

Unlock by Combination Code (FIG. 16):

When the user wants to operate the padlock 420, the user can touch the panel 270 to cause the keypad 230-239, the home button 250, and the set button 260 to be displayed on the panel. The user can type in a predetermined combination code and then press the home button 250. The electrical power is transferred to the solenoid 300 in a short period of time, about 10 seconds, for example. As the solenoid 300 is activated, the tip 301 of the solenoid 100 moves downward toward the solenoid body 3003. As the tip 301 of the solenoid 300 moves downward and out of the latch hole 281 of latch 280, the latch fork 282 is disengaged from the ring groove 292 of locking ring 290. As such, the user can pull the shackle 240 upward to release the short leg 241 out of the locking hole 351 of fixed cam 350 to operate the padlock in the opened mode. As the shackle 240 is pulled upward, the groove slope 293 of locking ring 290 also causes the latch 280 to move further way from the long leg 242 by pushing the fork slope 283 of latch 280. After about 10 seconds, the electrical power to the solenoid 300 can be cut off.

When the user relocks the padlock, the short leg 241 is moved into the locking hole 351 of fixed cam 350. At the same time, the locking ring 290, along with the long leg 242, move downward such that the groove of 292 aligns with the latch fork 282 of latch 280. The latch 280 is pushed by the urging force of the spring 380 and the latch fork 282 is caused to engage with the groove 292 of locking ring 290. As the solenoid 300 is no longer energized, the tip 301 of solenoid 300 is pushed upward by the spring 302 into the latch hole 281 of latch 280.

To Unlock by Key-Lock Mechanism (FIG. 29A and FIG. 29B):

When the padlock 420 is in the locked mode as the protrusion 243 is engaged with the groove 292 of the locking ring 290, the shackle 240 cannot be pushed upward to unlock the padlock 420. However, if a correct key 410 is inserted into the cylinder 330, the cylinder 330 can be rotated along with the rotatable cam 340. As the rotatable cam 340 is rotated, the cam slot 341 in the smaller cylindrical body 344 causes the locking pin 361 along with the blocking plate 360 to move downward to unblock the locking hole 351. As such, the short leg 241 of shackle 240 can be swung out of the locking hole 351 of fixed cam 350. This allows a key-lock user or a security officer to inspect a piece of luggage. To relock the padlock, simply rotate the short leg 241 of shackle 240 back into the locking hole 351 of fixed cam 350 and rotate the cylinder 330 in the opposite direction to remove the key 410. As the cylinder 300 is rotated in the opposite direction, the pin 361 is caused to move upward along with the blocking plate 360. As such, the blocking plate 360 prevents the short leg 241 of shackle 240 from being swung out of the locking hole 351. At all times, the long leg 342 of shackle 240 and the locking ring 290 remain in the downward position.

As with the embodiment as described and illustrated in FIGS. 1-13, various users can key in a combination code to unlock the combination lock and to reset the combination codes. The differences in the operating procedures with the embodiment as described and illustrated in FIGS. 14-30 are the green and red lights. The green light can be used to indicate the key entry is correct. The green light can also be arranged to flash during the reset mode.

Exemplary Padlock Components

Figure 31:
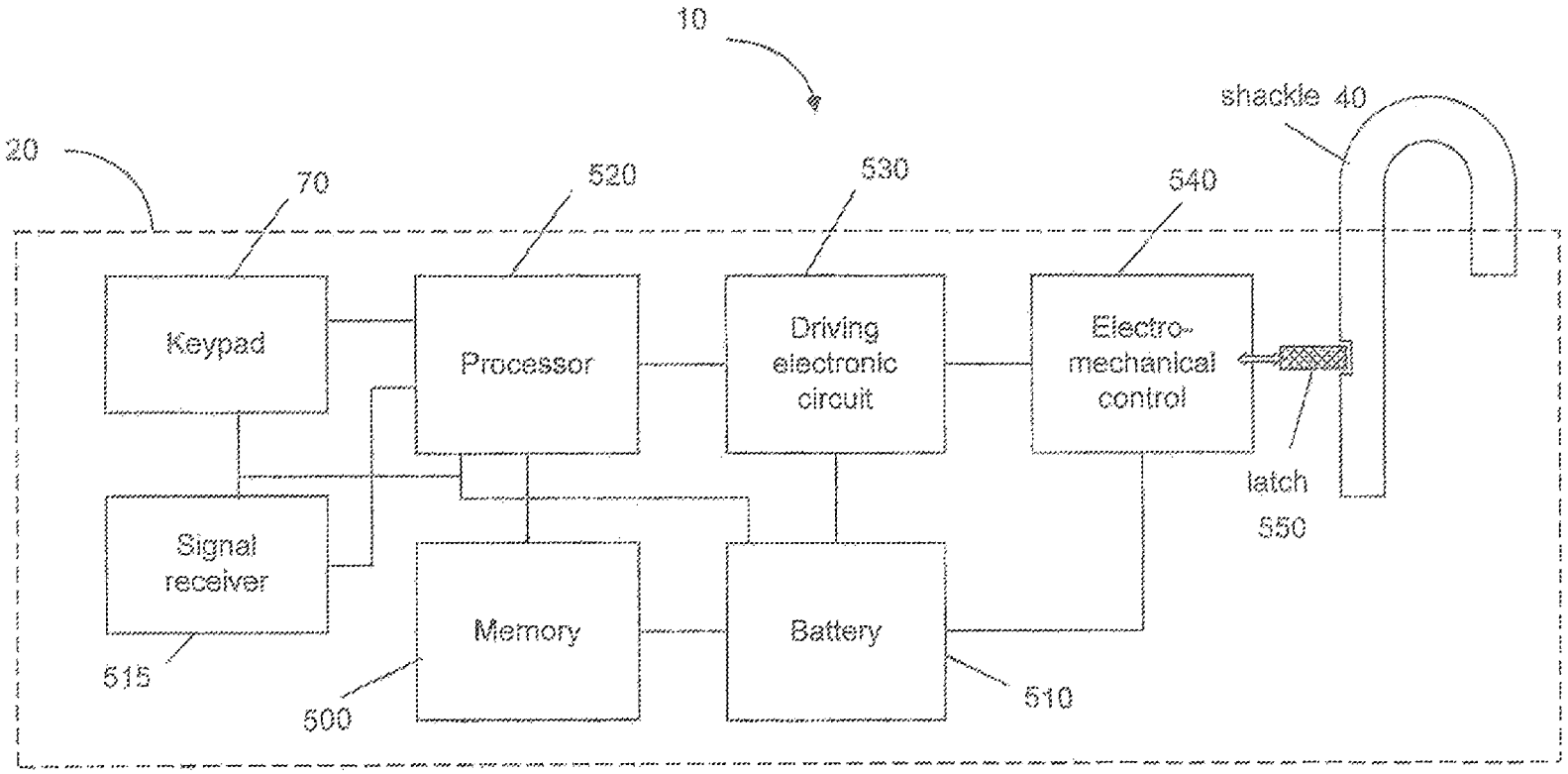
FIG. 31 is a block diagram showing the electronic components of the lock, according to an embodiment of the present invention.
Figure 32:
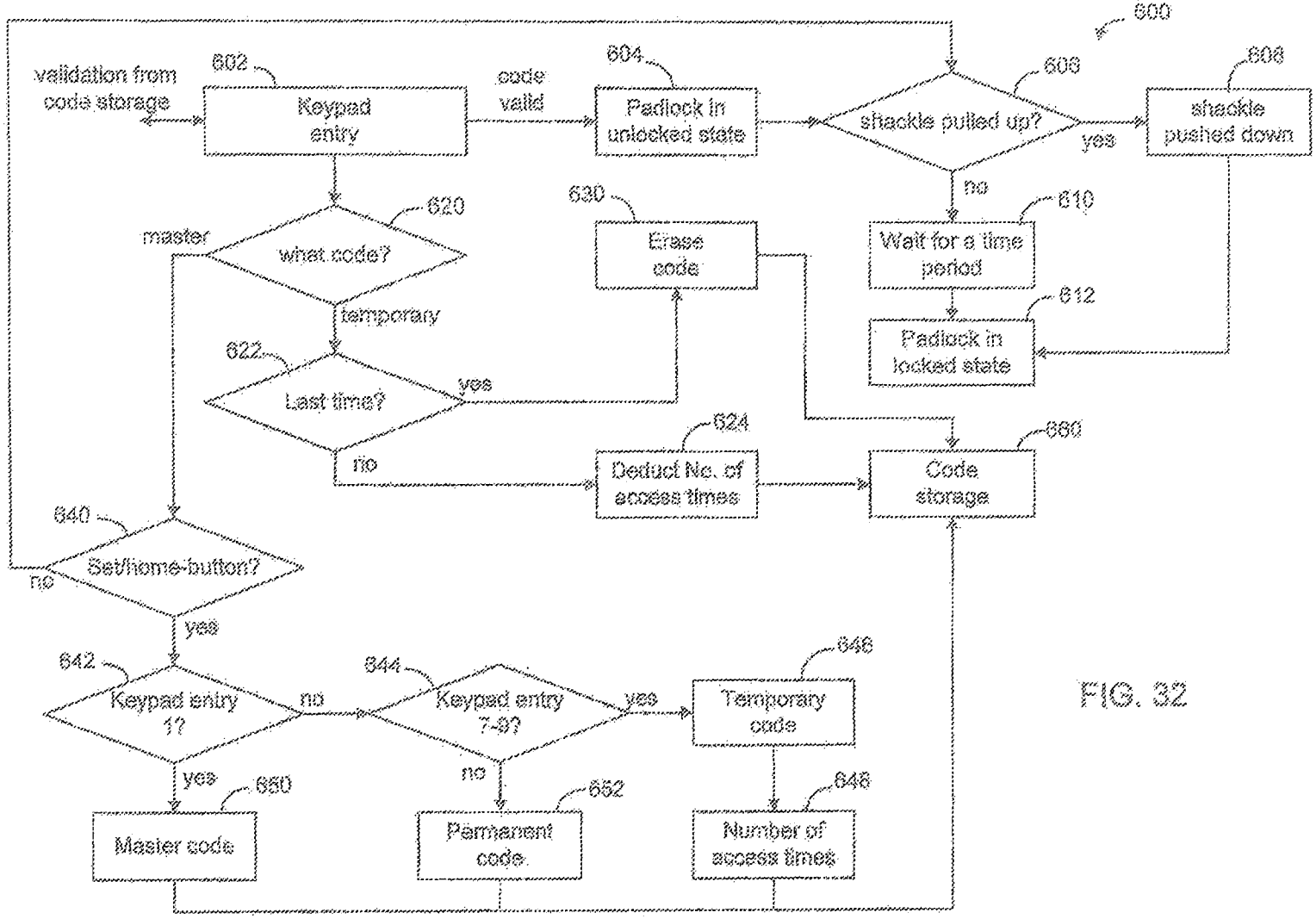
FIG. 32 is a flowchart illustrating a mode of operation of the combination lock, according to an embodiment of the present invention.

In an embodiment of the present invention, the padlock has various components as shown in FIG. 31. As shown in FIG. 31, the electronic padlock 10 includes:

a padlock housing or lock body 20; a keypad 70 for keypad entry; a processor 520 for receiving the keypad entry—the processor is programmed to carry out the mode of operation as shown in FIG. 32, for example; a memory 500 having a code storage to store codes and types of codes (the memory is a non-transitory for storing codes readable by the processor or a computer); a battery 510 to provide power to all the electronic components and electro-mechanical control; a driving electronic circuit 530 for driving the electro-mechanical mechanism or control 540 such as a solenoid which can change the positions of a mechanical latching device 550, such that when the mechanical latching device 550 is engaged in a notch or the like on the shackle 40, it prevents the shackle 40 from being pulled up to open the padlock. According to an embodiment of the present invention, the padlock housing 20 has an optional signal receiver 515 configured to receive an electronic signal from an electronic device indicative of a combination code and conveying the combination code to the processor 520.

Exemplary Mode of Operation

In an embodiment of the present invention, the electronic padlock can be operated according to processing steps as shown in FIG. 32 and described as follows:

Step 602: Upon receiving keypad entry from a user, if code is valid (as validated from the code storage) then the combination lock is in the unlocked state (state 604) and goes to step 620.

Step 604: Padlock is set in unlocked state and the process goes to step 606

Step 606: If shackle is pulled up, the process goes to step 608. If the shackle is pushed down at step 608, the padlock returns to locked state at step 612; if the shackle is not pulled up after a period of time as determined at step 610, the padlock returns to the locked state at step 612.

Step 620: the code type is determined: 1) if the code is a permanent code, nothing happens. 2) if the code is a temporary code and it is for the last access as determined at step 622, the code will be erased at step 630 and the code storage is adjusted accordingly at step 660; if the code is a temporary code and it can still be used for two or more times, the number of access times is reduced at step 624 and the code storage is adjusted accordingly; 3) if the code is a master code, it is determined at step 640 whether the user wants to reset the code. If the user wants to reset to code, the process goes to step 642; if not, the process goes to step 606.

Step 640: Upon receiving the reset entry from the user, the process goes to step 642.

Step 642: The user selects the type of code to be reset: if the type is master code, then the process goes to step 650, otherwise the process goes to step 644.

Step 644: If the type is a temporary code, the process goes to step 646. Otherwise the process goes to step 652.

Step 646: After the new temporary code is entered, the process goes to step 648.

Step 648: The user enters the number of access times for the temporary code, the code storage is adjusted accordingly at step 660.

Step 650: the user inputs a code as the new master code, the code storage is adjusted accordingly at step 660.

Step 652: the user inputs a code as the new permanent code, the code storage is adjusted accordingly at step 660.

Another Embodiment of the Present Invention

According to another embodiment of the present invention, the use of a touch screen panel 70 is not required. Accordingly, the numerical keypad 30-39 is affixed onto the panel-base 120/320. In particular, the numerical pad is already on the panel-base 120/320 for a user to input the combination code.

Remote Entry of Combination Code

In an embodiment of the present invention, the combination code can also be conveyed to the electronic processor 520 by an electronic device that is detached from the electronic combination lock. As seen in FIG. 31, the padlock housing 20 has a signal receiver 515 electrically connected to the electronic processor 520. The signal receiver 515 is configured to receive an electronic signal indicative of a combination code and to convey the received combination code to the electronic processor 520 to determine if the combination code matches a preset code (stored code). The electronic signal can be a Bluetooth signal from an electronic device such as a cellphone, or a longer-range signal from a remote transmitter.

With the signal receiver, a user can open the electronic combination lock by entering the combination code through the touch panel or by sending an electronic signal indicative of the combination code from a detached electronic device.

Operations on a Combination Lock from a Detached Mobile Device

Figure 33:
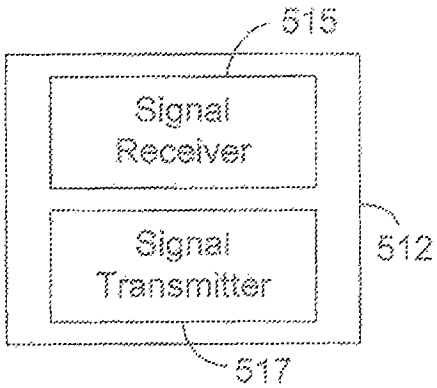
FIG. 33 is a block diagram showing a transceiver module having a signal transmitter and a signal receiver, according to an embodiment of the present invention.

As seen in FIG. 31, the padlock housing 20 has a signal receiver 515 configured to receive an electronic signal indicative of a combination code from a detached electronic device. The electronic device can be a hand-held device such as a mobile phone having Bluetooth communication channels or the like. In an embodiment of the present invention, the signal receiver 515 is part of a transceiver module 512 which also has a signal transmitter 517 as shown in FIG. 33. In an embodiment of the present invention, the signal transmitter 517 is configured to transmit Bluetooth signals.

Figure 34:
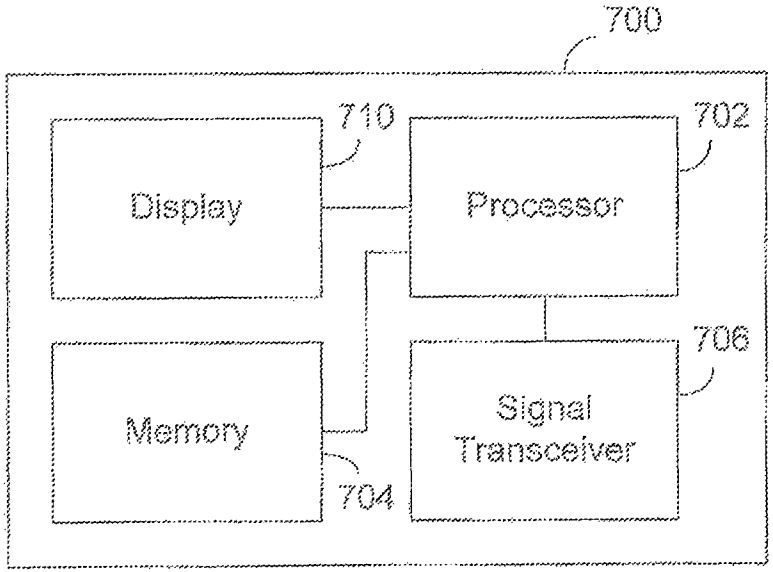
FIG. 34 is a block diagram showing some of the electronic components in the mobile device, according to an embodiment of the present invention.

In an embodiment of the present invention, the electronic device has various components as shown in FIG. 34. As shown in FIG. 34, the electronic device 700 includes a processor 702, a memory 704, a signal transceiver module 706 and a display or display screen 710. The signal transceiver module 706 is configured for wireless communications, including Bluetooth communications. The display screen 710 is arranged to display information and to receive user input, for example. In other words, the display screen 710 is arranged to allow entry of information to be wirelessly transmitted to the electronic combination locks within a communication range. The information may be indicative of a password, an access level and so forth. The information may include a command to unlock the electronic combination lock if the password matches a preset code in the lock. The memory 704 is a non-transitory memory used for storing Bluetooth pairing information, including identity of a combination lock that has been electronically linked or paired with the electronic device, for example. The processor 702 can be programmed to carry out communications via the transceiver module 706 between the electronic device 700 and one or more electronic combination locks 10. The electronic device 700 can be a mobile phone or the like.

Figure 35B:
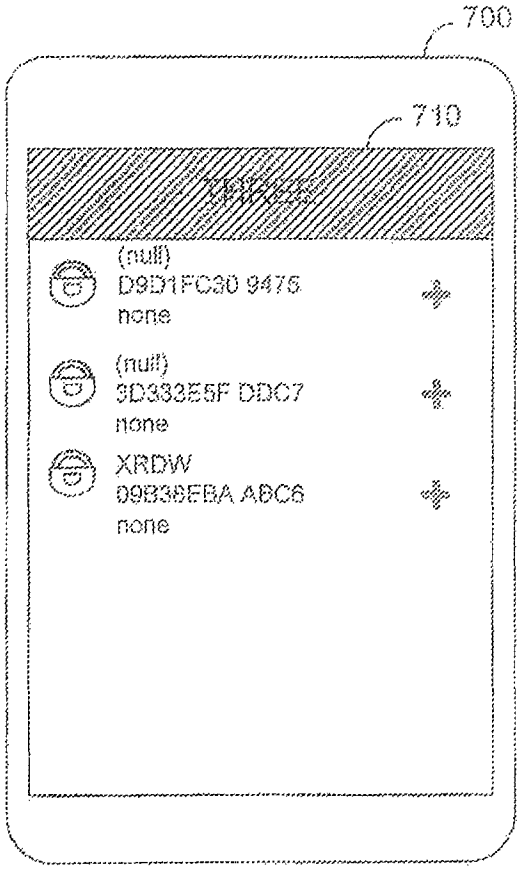
FIG. 35B illustrates the display screen of the mobile device having a list of combination locks that have not been electronically linked or paired with the mobile device.
Figure 35A:
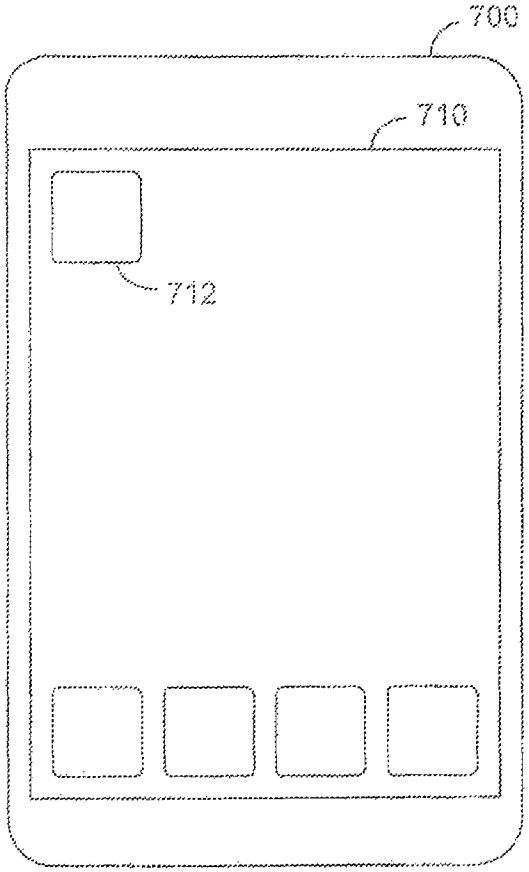
FIG. 35A illustrates the display screen of the mobile device having an application icon.
Figure 35D:
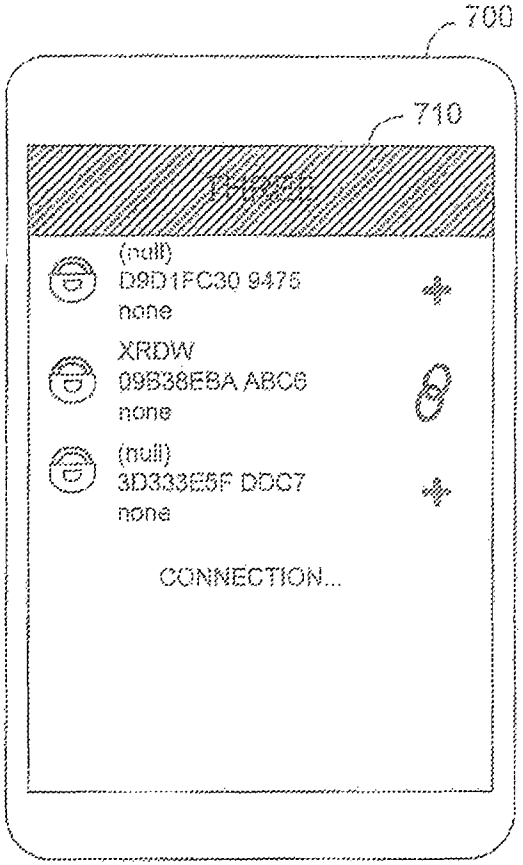
FIG. 35D illustrates the display screen of the mobile device having a list of combination locks with one of them having been electronically linked to the mobile device.
Figure 35C:
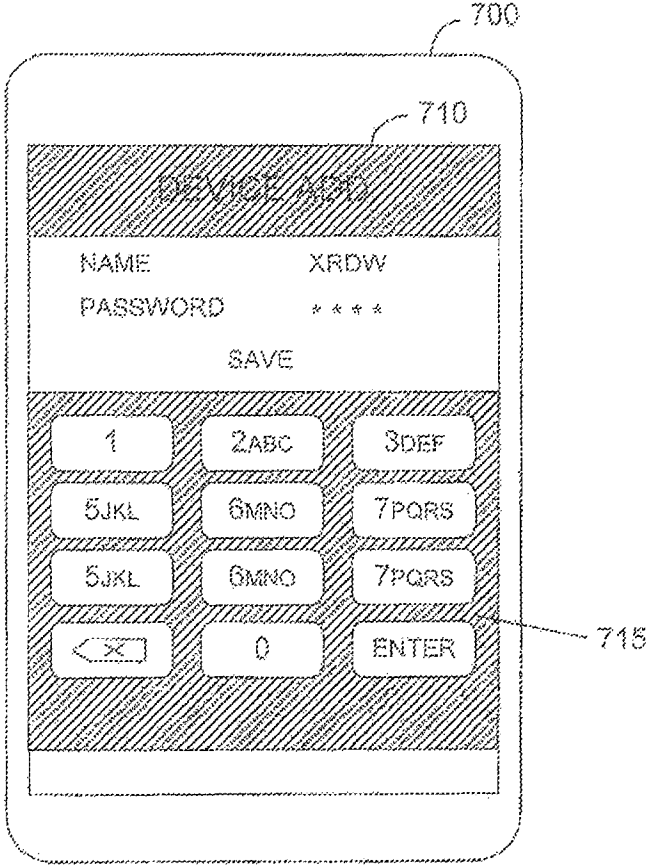
FIG. 35C illustrates the display screen of the mobile device having an electronic keypad to allow entry of a password, for example.

A general mode of operations between the electronic device 700 and the electronic combination locks 10 is shown in FIGS. 35A-35E. As shown in FIG. 35A, the electronic device 700 has a display 710 with an application icon 712 (commonly known as App). The application icon 712 is arranged for communication with one or more electronic combination locks 10. When the application icon 712 is activated, the processor 702 (see FIG. 34) is arranged to provide a wireless signal (such as Bluetooth signal) for searching the electronic combination locks 10 within of the wireless signal range. If the search is successful, the display 710 shows a list of three electronic combination locks 10 found as shown in FIG. 35B. Each of the electronic combination locks in the list may have an electronic identity associated thereto and a given name. For example, one of the locks has a name "XRDW". The user of the electronic device 700 may select one of the locks to establish a communication link between the electronic device 700 and the selected lock 10. It should be noted that the selected lock may or may not have paired with the electronic device. If they have been paired, the user can enter the correct password on the electronic device to open the lock. If they have not been paired, the user can enter on the electronic device a factory-provided "admin code" of the lock or a given preset code stored in the lock for pairing. For example, the "admin code" can be 0-0-0-0. The "admin code" may have been changed to a preset code different from the "admin code". As shown in FIG. 35C, the user can use the keypad 715 to enter a password indicative of the "admin code" or the preset code and press "SAVE" in order to add the selected lock as a paired lock in the memory 704 of the electronic device 700 (see FIG. 34).

Figure 35F:
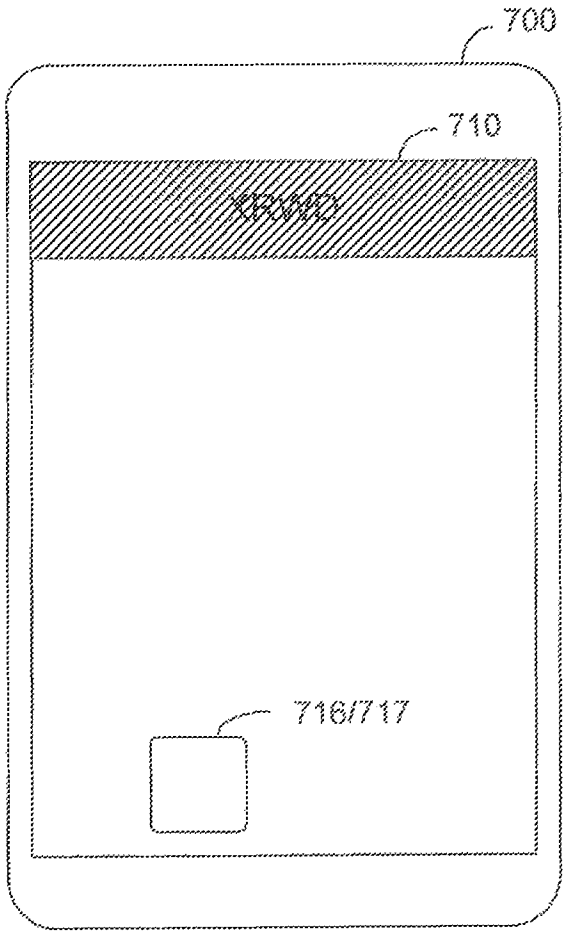
FIG. 35F illustrates the display screen of the mobile device having a deactivation/re-activation icon associated with the user of the first level.
Figure 35E:
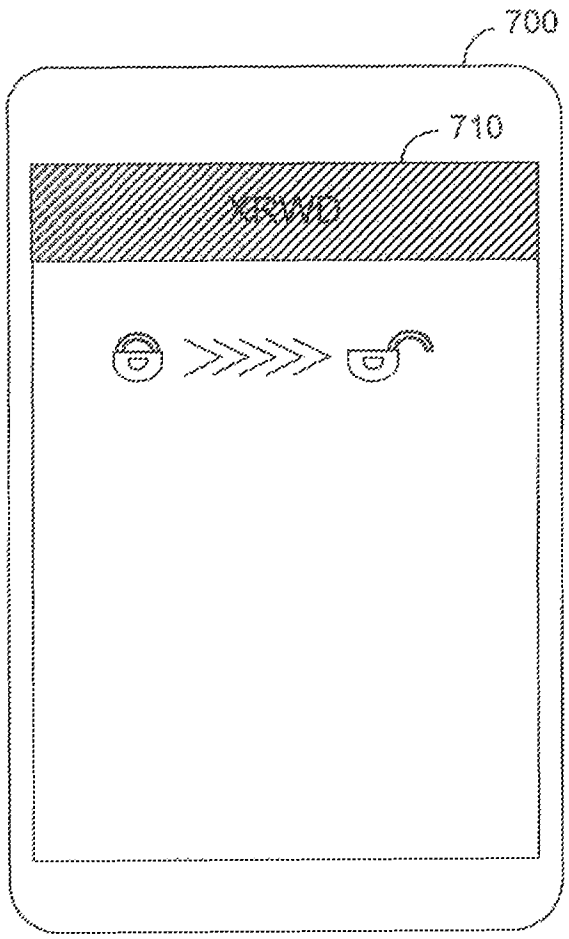
FIG. 35E illustrates the display screen of the mobile device having a graphical indication of a gesture for unlocking the selected combination lock.

As can be seen in FIG. 35D, the selected lock "XRDW" is now linked to the electronic device 700. The user may want to unlock the linked XRDW lock by selecting it from the list. The linked XRDW can be unlocked by a swiping action as indicated on the display 710 as shown in FIG. 35E.

Figure 36:
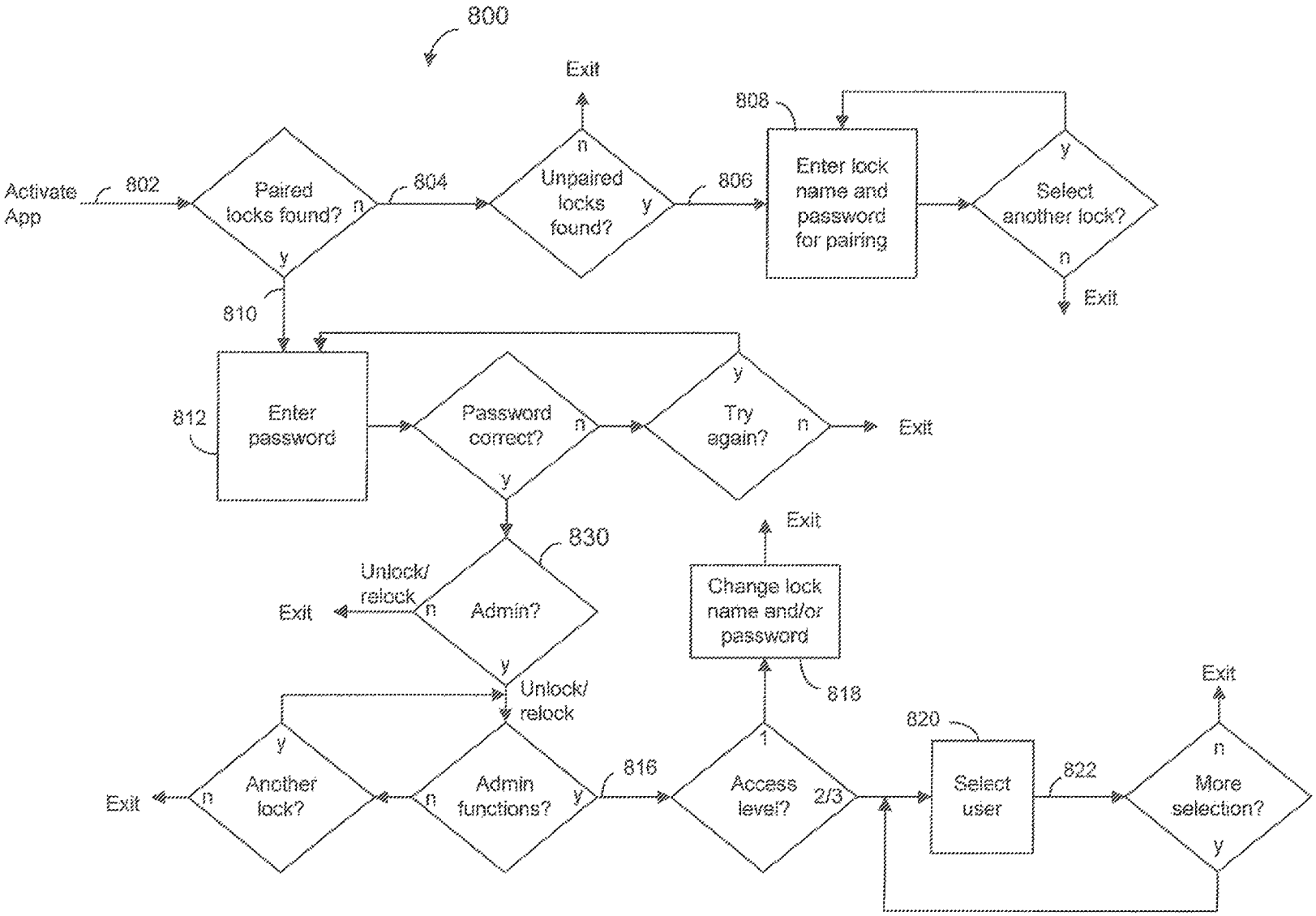
FIG. 36 is a flowchart illustrating a mode of operation of the mobile device in communication with one or more electronic combination locks.

FIG. 36 is a flowchart showing the general operations of the electronic combination lock 10 using a detached electronic device 700 (see FIGS. 35A-35E). When the application icon 712 is activated, the electronic device 700 is arranged to search for the electronic combination locks within the search range at step 802. If no paired locks are found in the search, the electronic device 700 can be activated to search for unpaired locks at step 804. For example, the display 710 may have a symbol such as "+" to allow the user to initiate the search. If no unpaired locks are found in the search, the search mode of the application icon is terminated. If one or more unpaired locks are found, the display 710 of the electronic device 700 is arranged to display a list of the unpaired locks and the user may select one of the listed locks for pairing purposes at step 806. For example, the display 710 may show a selection symbol such as "+" associated with each of the listed locks (see FIG. 35B, for example). The user can click or activate the selection symbol to select one of the locks. The user may provide a name and a password of the selected lock at step 808 and press "SAVE" to complete the pairing process (see FIG. 35C, for example). The pairing process for the other listed locks can be carried out in the same manner.

If one or more paired locks are found in the search at step 802, the display 710 of the electronic device 700 may provide a list of those paired locks. For example, the display 710 may have a selection symbol "+" to allow the user to select a paired lock from the list for management purposes at step 810. The user may delete a paired lock from the list by making a certain gesture on the display 710. At step 812, the user is required to enter a password associated with the selected lock. If the entered password does not match the stored code in the lock, the display 710 may indicate that the entered password is incorrect and the user may try again. If the entered password is correct, the user may unlock the lock from the electronic device 700 by making a certain gesture (see FIG. 35E, for example). If the user is a basic user (permanent user or a user of a second access level with a permanent code) or a temporary user (user of a third access level with a limited number of access times), the communications session between the electronic device 700 and the lock may be ended. If the user is an administrator (a user of a first access level with a master code, or the first-level user), the first-level user may choose to perform a certain administrative function on the selected lock by activating a symbol such as "SETTING" to enter into the administration level where the administrator can assign a number of basic users and a number of temporary users or to change the master code. At step 816, the first-level user may choose to perform an administrative function on one of the access levels. If the chosen access level is the first access level, the first-level user can change the lock name and/or the password and save the changes at step 818. If the chosen access level is the second access level or third access level, the first-level user may choose a user of those levels at step 820 and change or assign a password for the chosen user at step 822. In an embodiment of the present invention, if the chosen access level is the second access level, the display 710 of the electronic device 700 may show a list of one or more basic users that are authorized to use the lock an unlimited number of times. For example, the list may contain five users such as user 2, user 3, . . . and user 6 associated with the keypads 32-36 on the combination lock 10 (see FIG. 1). The first-level user can assign or change a password for each of the basic users. If the selected access level is the third level, the display 710 of the electronic device 700 may show a list of one or more temporary users that are authorized to use the lock a limited number of times. For example, the list may contain three users such as user 7, user 8 and user 9 associated with the keypads 37-39 on the combination lock 10 (see FIG. 1). The first-level user can assign a password for each of the temporary users. The process can be repeated for other users in the same manner.

In summary, the present invention provides a method and device for operating one or more electronic combination locks through wireless communications. Preferably, the device is a mobile device such as a mobile phone configured for communications in Bluetooth wireless channels. The mobile device has a display configured to display information and to allow entry of information. The display may have an application icon (commonly known as an App) arranged for communication with a combination lock. The mobile device has an electronic circuit configured to provide a wireless signal when the application icon is activated, the wireless signal indicative of a combination code for operating the combination lock at one of a plurality of access levels, wherein the access levels define the number of access times for unlocking the combination lock. The wireless signal may comprise a communication signal for electronically linking the combination lock to the electronic device in a pairing process. The mobile device has a non-transitory memory unit, the memory unit configured for storing identity of the combination lock that has been electronically linked to the electronic device. The display is arranged to show a list of one or more combination locks found in the search range that have been electronically linked to the electronic device, and the display is further configured to allow deletion of one or more combination locks shown on the list from the memory unit. The display may have a graphic keypad to allow entry of information indicative of the combination code for operating the combination lock, wherein if the combination code matches the preset code for said combination lock, the display is arranged to allow making a gesture on the display for unlocking the combination lock. The display is also arranged to allow entry of a new code from the display for replacing the preset code in said combination lock. The display is arranged to allow entry of information from the display indicative of assignment of one or more users of second level and/or third level for said combination lock, and the information may include the number of access times of the users of third levels. The assignment of a user of second level and/or third level may include an entry from the display of a number associated with one of the plurality of numeral keys.

According to an embodiment of the present invention, the padlock 10 and its components as illustrated in FIGS. 1-13B and 31 can be unlocked by a combination code entered as a keypad entry via the touch panel 70. The padlock 420 and its components as illustrated in FIG. 14A-30 can be unlocked using a combination code entered as a keypad entry via the touch panel 270 or by a key 410 operating on the cylinder 330 (see FIGS. 29A and 29B, for example). The padlock 10 and the padlock 420 can also be unlocked using a password conveyed via a wireless signal by an electronic device 700 as illustrated in FIGS. 34-35E. The process of unlocking the padlock 10 or padlock 420 with a keypad entry is illustrated in FIG. 32. As illustrated in FIG. 32, if the combination code provided in the keypad entry at step 602 is valid, the padlock is set in an unlocked state. As illustrated in FIG. 36, if the password conveyed from the electronic device 700 to a paired padlock at step 812 matches a combination code stored in the padlock, the padlock can be unlocked. If the user is an administrator (a user of a first access level with a master code or a first-level user) as determined in step 830, the user may choose to perform one or more administrative functions.

According to an embodiment of the present invention, the keypad entry to the padlock 10 and padlock 420 can be disabled by an administrator using the electronic device 700 via a wireless signal. For example, the display 710 of the electronic device 700 may have an icon 716 as shown in FIG. 35F. The icon 716 can be a "deactivation" icon associated only with the combination code for the first level. When the deactivation icon is activated, a wireless signal from the electronic device is arranged to block the keypad entry, effectively deactivating the touch panel. Once the keypad entry is blocked, the padlock cannot be unlocked by entering a combination code via the touch panel 70 of padlock 10 or the touch panel 270 of padlock 420. To re-activate the keypad entry, the display 710 of the electronic device 700 may also have a "re-activation" icon 717 associated only with the combination code for the first level. When the re-activation icon is activated, a wireless signal from the electronic device effectively reactivates the keypad entry to allow a user to unlock the padlock using the touch panel.

Figure 37A:
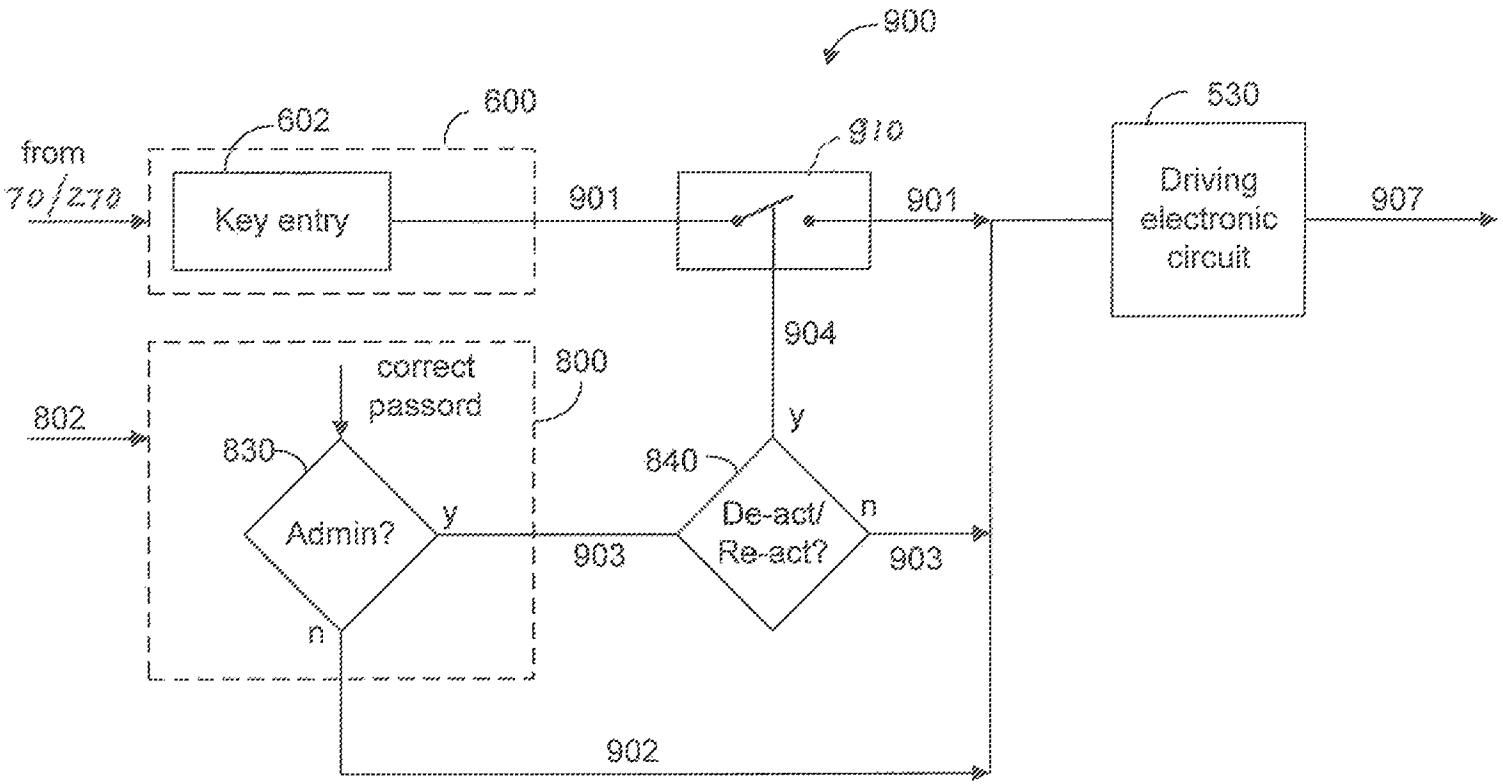
FIG. 37A is a flowchart showing the deactivation and re-activation of the touch panel by an electronic circuit, according to an embodiment of the present invention.

The deactivation and reactivation of the keypad entry can be carried out in an electronic circuit 900 as shown in FIG. 37A. The circuit 900 combines the circuit elements of the padlock 10 as shown in FIG. 31, and the processing steps in the flowchart 600 as shown in FIG. 32 and in the flowchart 800 as shown in FIG. 36, for example. As seen in FIG. 37A, the circuit 900 includes a switch 910 to control the keypad entry from the touch panel 70 or 270. The switch 910 can be an electronic switch made from one or more semiconductor switching elements or an electro-mechanical switch. When the touch panel of the padlock is not deactivated by the electronic device 700, the switch 910 allows a user to unlock the padlock by entering a combination code on the touch panel 70/270. If the combination code is valid as determined at the keypad entry step 602, an unlocking signal 901 is conveyed to the driving electronic circuit 530 to unlock the padlock (see FIG. 31). When a wireless signal indicative of a password is conveyed from the electronic device 700 to the signal transceiver circuit 512, the signal receiver 515 is arranged to send information indicative of the password to the processor 520 (see FIG. 31) to carry out the processing steps as shown in the flowchart 800 (see FIG. 36). In particular, when the password matches the combination code, an unlocking signal 902 or 903 is conveyed to the driving electronic circuit 530 to unlock the padlock. However, if the combination code is a code for the first level and the wireless signal is indicative of a deactivation signal as determined at step 840, the switch 910 is caused to open by a signal 904, effectively blocking the unlocking signal 901 from reaching the driving electronic circuit 530. Nevertheless, a user of the first level, second level or the third level is still able to unlock and relock the padlock 10 or padlock 420 using an electronic device 700. When the driving electronic circuit 530 receives an unlocking signal (901, 902 or 903), it sends out an activating signal 907 to energize the electro-mechanical device (100, 300) in the padlock (10, 420). According to an embodiment of the present invention, the switch 910 functions like a toggle switch in that the switch 910 remains open until a "re-activation" wireless signal is conveyed to the padlock from the electronic device 700, as initiated by the administrator. The signal 904 is arranged to close the switch 910, allowing the unlocking signal to reach the driving electronic circuit 530. Again, only the first-level user or administrator can initiate the deactivation/re-activation function carrying out on an electronic padlock via a wireless signal from the electronic device.

According to an embodiment of the present invention, the deactivation function carrying out on an electronic padlock, such as padlock 420 as illustrated in FIGS. 14A to 30, is applied to the disabling of the keypad entry, but not the key-lock mechanism. This means that, while the user cannot unlock the padlock using the touch panel 270, a person having a correct key 410 is still able to unlock the electronic padlock. According to another embodiment of the present invention, the deactivation function is also arranged to disable the key-lock mechanism of an electronic padlock such as padlock 1600 as illustrated in FIGS. 38-55.

According to an embodiment of the present invention, the padlock 1600 can be unlocked in three ways: a combination code entered as keypad entry through a touch panel, a correct key operated on a key-lock mechanism, or a wireless signal conveying a password from a detached electronic device. The touch panel and the key-lock mechanism can be disabled by a wireless signal conveyed from the electronic device to the padlock initiated by a first-level user. Once the touch panel and the key-lock mechanism of the padlock are deactivated, the padlock can only be unlocked and relocked via the electronic device by the first-level user. However, in order to re-activate the key-lock mechanism, the user must use a re-activating key.

Active State—Locked Mode (FIGS. 37A-52)

When the padlock 1600 is in an active state and operated in the locked mode, the padlock can be unlocked by using the touch panel, the key-lock mechanism or a detached electronic device. According to an embodiment of the present invention, the detached electronic device is similar to the electronic device 700 as illustrated in FIGS. 34-36. Accordingly, the padlock 1600 also comprises the electronic components as shown in FIG. 31 and a signal transmitter as shown in FIG. 33.

Figure 15:
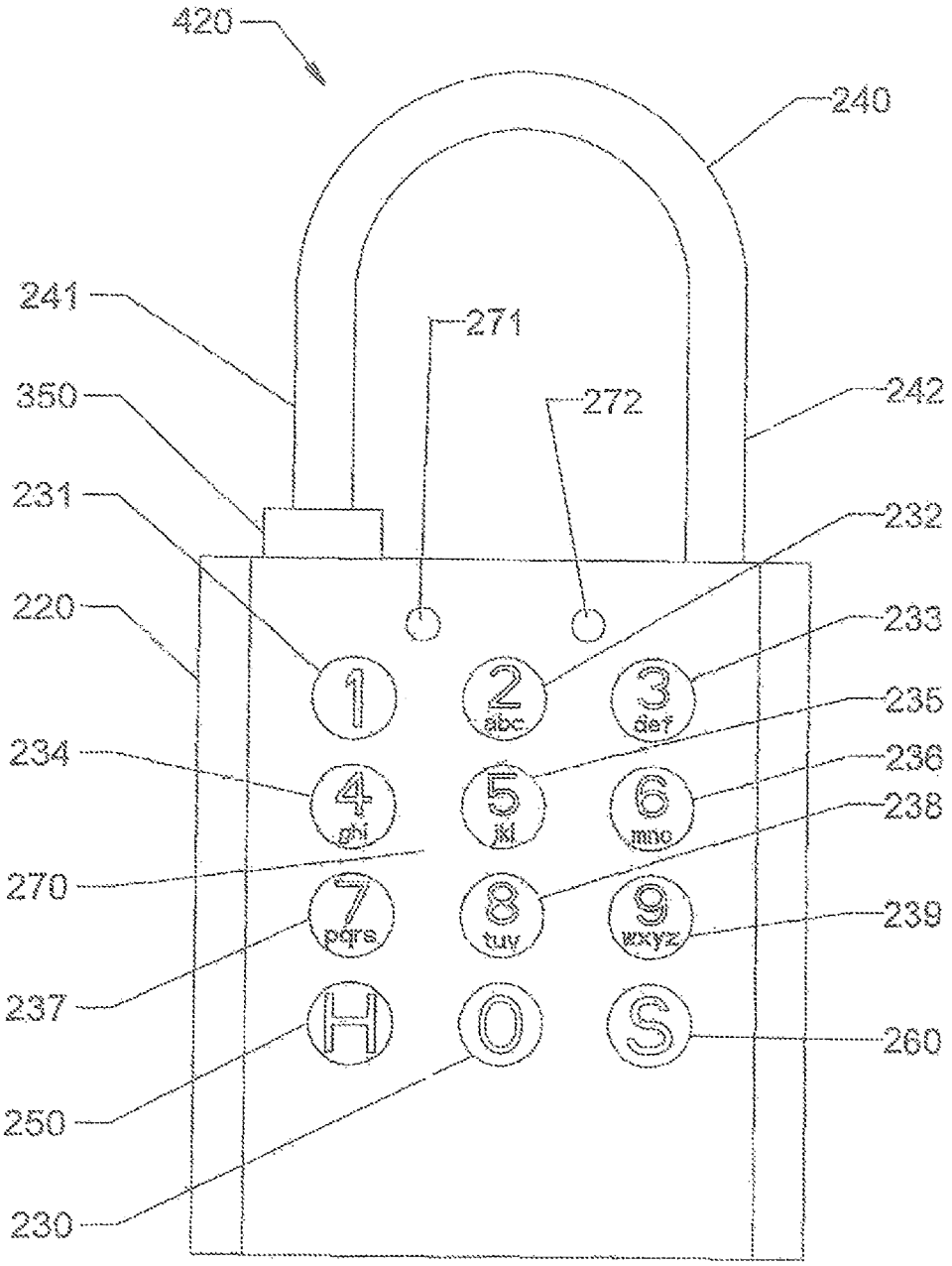
FIG. 15 is a front view of the combination lock of FIG. 14A.
Figure 16:
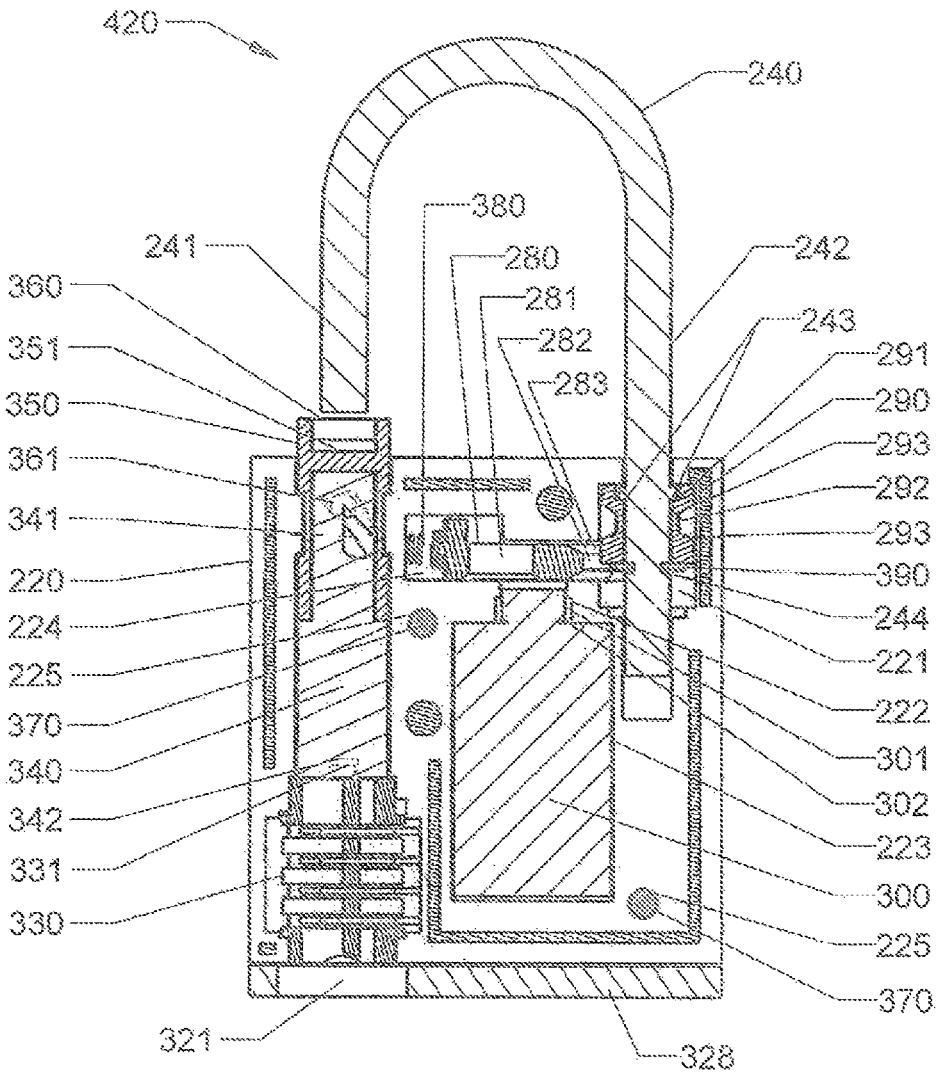
FIG. 16 is a cross sectional view of the combination lock of FIG. 14A when the lock is operated in an opened mode.
Figure 38:
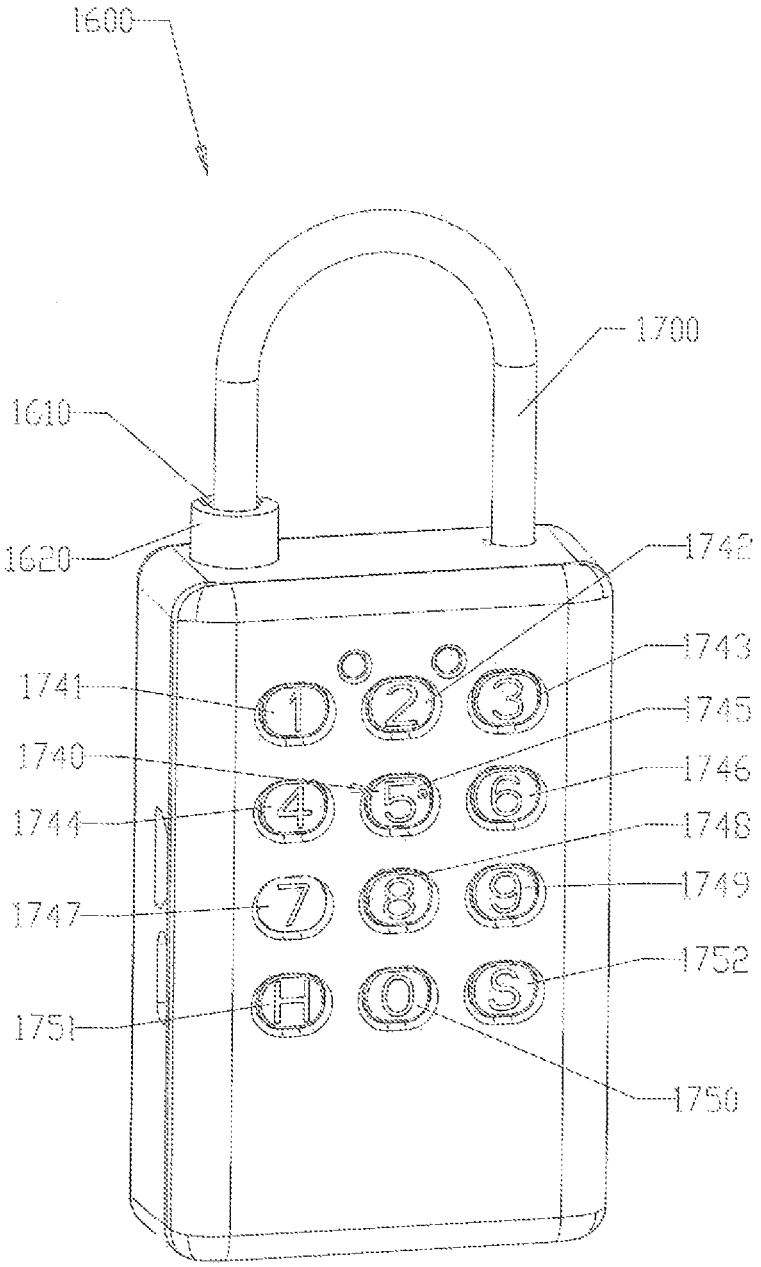
FIG. 38 illustrates an electronic combination lock having a touch panel, according to an embodiment of the present invention.

The padlock 1600 as shown in FIG. 38 has a shackle 1700 with a short leg 1701 (toe) and a long leg 1704 (heel), and a touch panel 1740 which is similar to the touch panel 270 of padlock 420 (see FIG. 15). The touch panel 1740 also has ten numeral keypads 1741-1750, a home button 1751 and a set button 1752 to allow a user to unlock the padlock 1600, for example. The touch panel 1740 is electronically linked to an electronic-lock mechanism which controls the locking and unlocking of the padlock 1600. The padlock 1600 also has a key-lock mechanism to allow a person with a correct key to unlock the padlock 1600.

The padlock 1600 has a lock body 1601 to dispose the electronic-lock mechanism and the key-lock mechanism. The electronic-lock mechanism includes a single-hole latch 1660 (also referred to as a controlling latch), a lock ring 1680 with a ring neck 1681, a solenoid 1690 having a retractable shaft 1691 and a body-inner case 1710. The key-lock mechanism includes a blocking plate 1610, a fixed cam 1620, a rod 1630 with a rod slope 1631, a rotatable cam 1640, a cylinder 1650, a double-hole latch 1670 (also referred to as a locking latch) which is also linked to the solenoid 1690. The body-inner case 1710 has various openings to receive the other components, including a shackle channel 1712 dimensioned for placement of the long leg 1704 of the shackle 1700. The blocking plate 1610 has a driving pin 1611 and a de-activating cutout 1612. The fixed cam 1620 has a re-activating hole 1621 and a de-activating edge 1622. The rotatable cam 1640 has a pin slot 1641, an inner hole 1642 and two cylinder-receiving holes 1643. The cylinder 1650 has a pair of extended pins 1651 on the upper side and a cylinder slot (not shown) on the lower side arranged to receive a key 1653 (see FIG. 53). The single-hole latch 1660 has a groove 1661 and a locking hole 1662. The double-hole latch 1670 has an activating hole 1671, a de-activating hole 1672 and a latch edge 1673. The long leg 1704 of the shackle 1700 has a pair of protrusions 1702 and a cutout neck 1703. The locking ring 1680 is assembled between the protrusion 1702 and the cutout neck 1703 of the shackle 1700, with C-clip 1720 inserted into the cutout neck 1703 to secure the placement of the locking ring 1680 on the shackle 1700.

When the padlock 1600 is operated in the locked mode in the active state, the shaft 1691 of the solenoid 1690 is located in the activating hole 1671 of the double-hole latch 1670 and also received into the locking hole 1662 of the single-hole latch 1660. The groove 1661 of the latch 1660 is received in the ring neck 1681 of the locking ring 1680.

Figure 51:
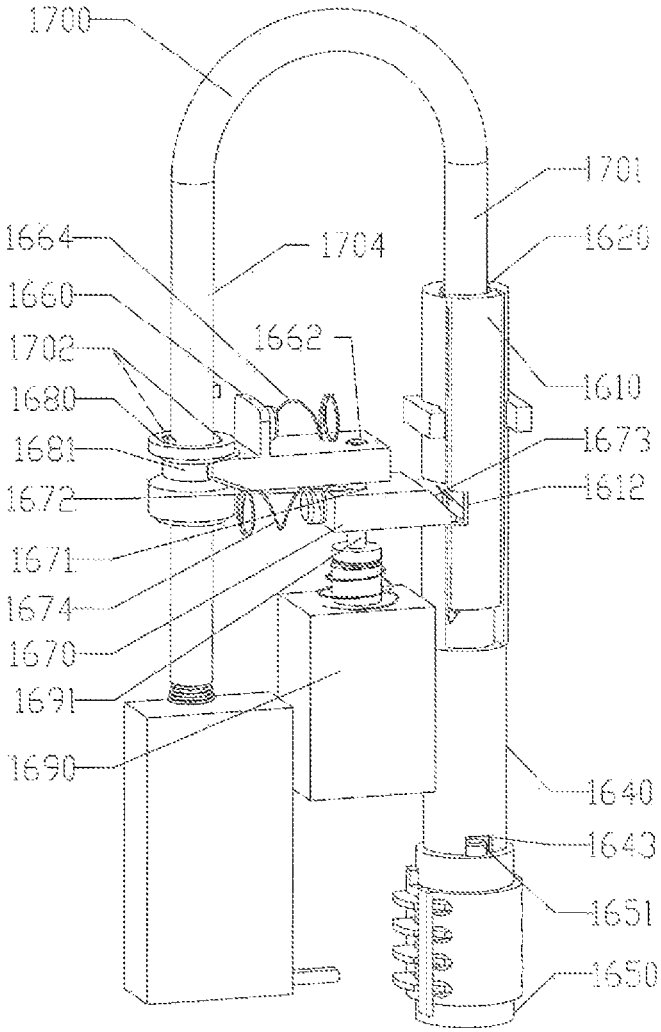
FIG. 51 shows various interconnecting components of the combination lock, according to an embodiment of the present invention.

As seen in FIG. 51, the blocking plate 1610 and the fixed cam 1620 are placed together as an engaged assembly to receive the short leg 1701 of the shackle 1700 and the upper part of the rotatable cam 1640. The blocking plate 1610 can be caused to move downward relative to the fixed cam 1620 to release the short leg 1701 of the shackle 1700. The rotatable cam 1640 is positioned such that the driving pin 1611 of the blocking plate 1610 is movably engaged in the pin slope 1641 of the rotatable cam 1640. The rotatable cam 1640 is placed on the upper side of the cylinder 1650 such that the extended pins 1651 of the cylinder 1650 are engaged with the cylinder-receiving holes 1643 of the rotatable cam 1640.

Figure 39:
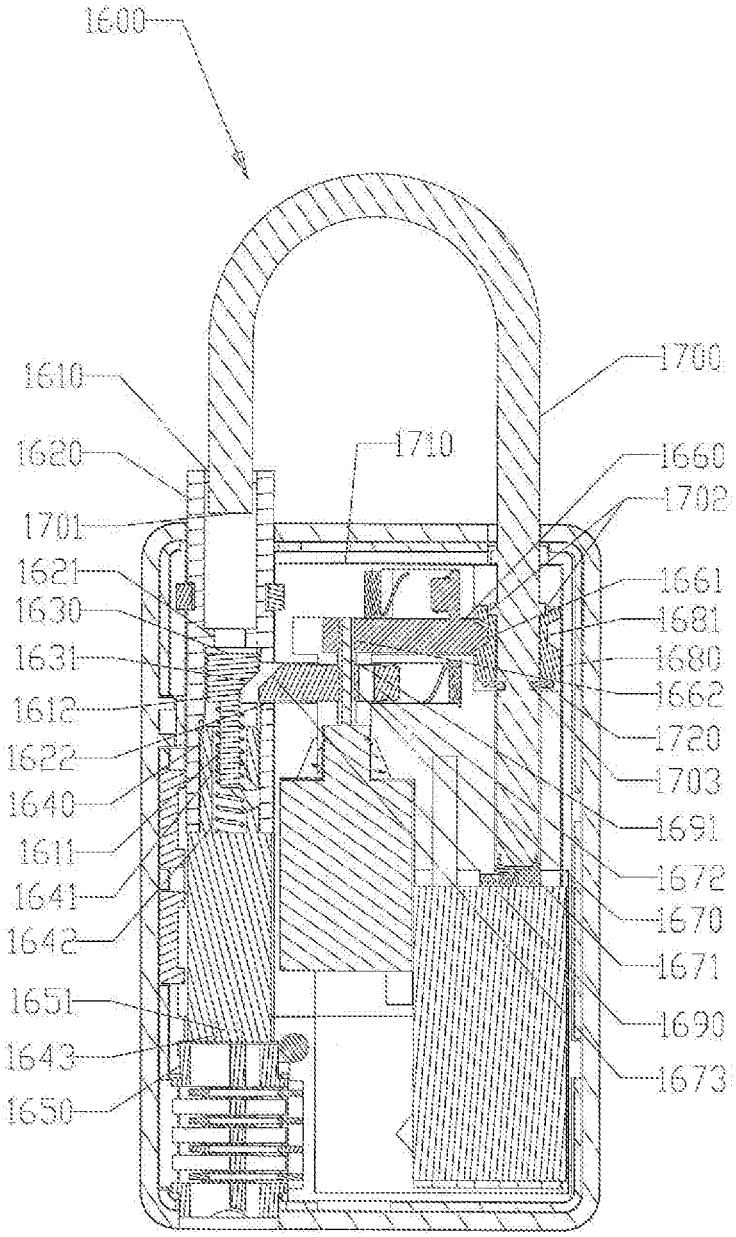
FIG. 39 is a cross-sectional view of the electronic combination lock of FIG. 38.
Figure 40:
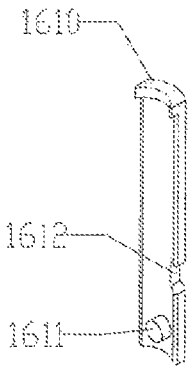
FIG. 40 illustrates a blocking plate, according to an embodiment of the present invention.
Figure 41:
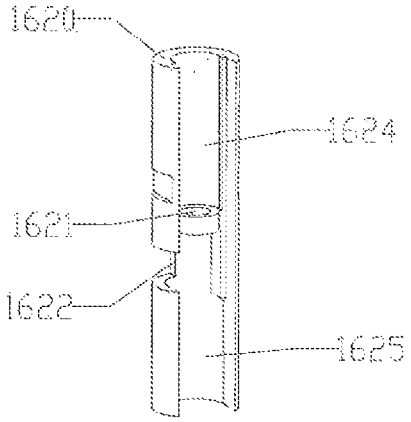
FIG. 41 illustrates a fixed cam, according to an embodiment of the present invention.
Figure 42:
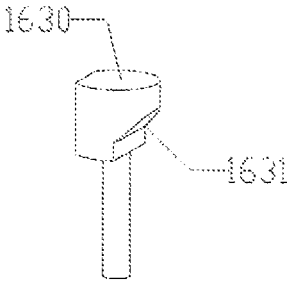
FIG. 42 illustrates a rod with a rod slope, according to an embodiment of the present invention.
Figure 43:
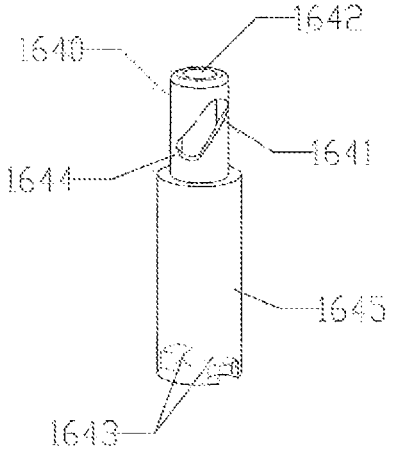
FIG. 43 illustrates a rotatable cam, according to an embodiment of the present invention.
Figure 44:
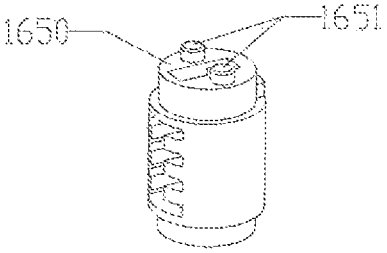
FIG. 44 illustrates a cylinder, according to an embodiment of the present invention.
Figure 45:
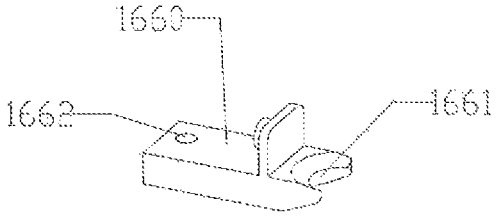
FIG. 45 illustrates a controlling latch, according to an embodiment of the present invention.
Figure 46:
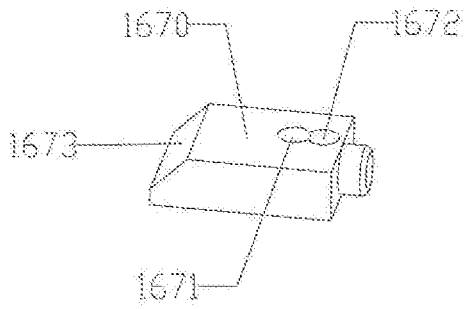
FIG. 46 illustrates a locking latch, according to an embodiment of the present invention.
Figure 47:
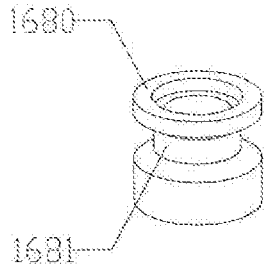
FIG. 47 illustrates a locking ring to be installed on the long leg of the shackle, according to an embodiment of the present invention.
Figure 48:
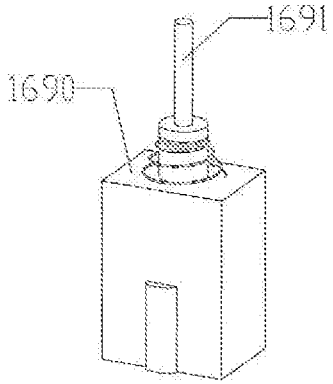
FIG. 48 illustrates a solenoid having a retractable shaft, according to an embodiment of the present invention.
Figure 49:
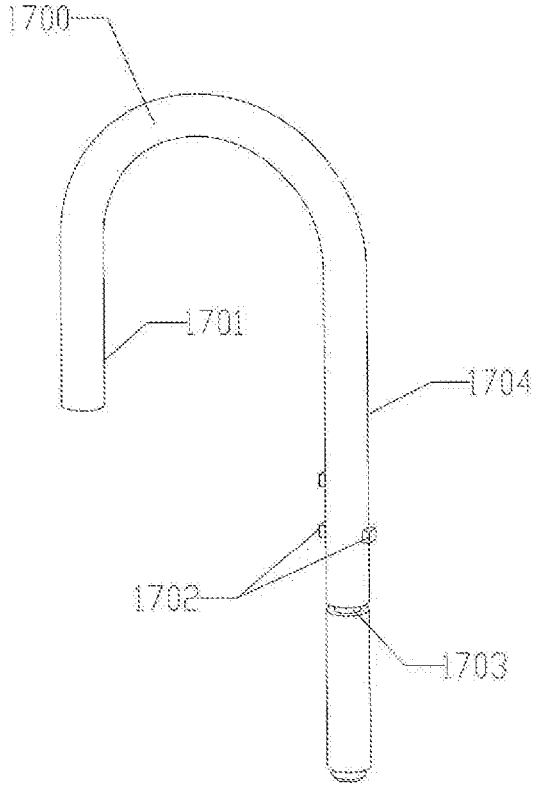
FIG. 49 illustrates the shackle, according to an embodiment of the present invention.
Figure 50:
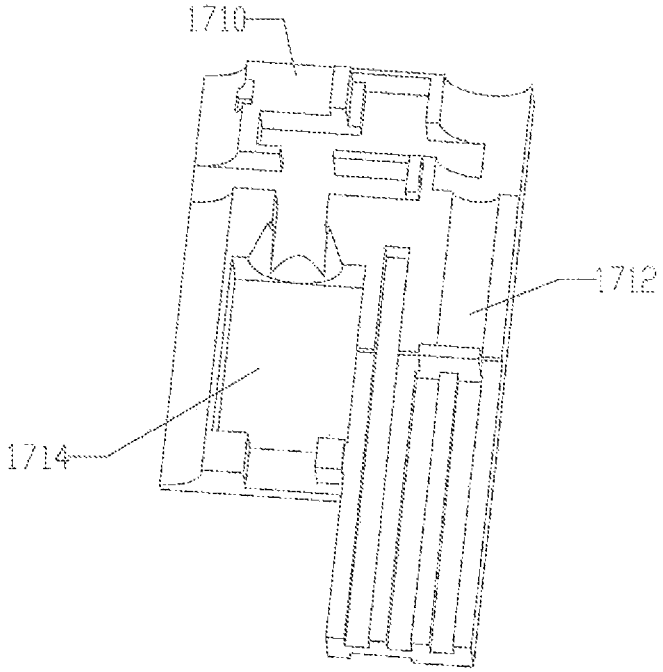
FIG. 50 illustrates part of the body inner-case, according to an embodiment of the present invention.

There is no rotational movement of the cylinder 1650 relative to the lock body 1601 when there is no key inserted into the cylinder 1650. As the extended pins 1651 of the cylinder 1650 are engaged with the cylinder-receiving holes 1643 of the rotatable cam 1640, there is no rotational movement of the rotatable cam 1640 and the position of the pin slope 1641 remains stationary. The position of the driving pin 1611 also remains unchanged such that the short leg 1701 of the shackle 1700 is engaged with the blocking plate 1610 and the fixed cam 1620, preventing the shackle 1700 from rotating relative to the lock body 1601 to change the padlock 1600 from the locked mode to the opened mode. However, as shown in FIGS. 39 and 51, the latch edge 1673 of the double-hole latch 1670 is disengaged from the de-activating cutout 1612 of the blocking plate 1610. As such, when a correct key is inserted into the cylinder 1650 to rotate the cylinder 1650, the rotatable cam 1640 is rotated relative to the double-hole latch 1670.

Figure 52:
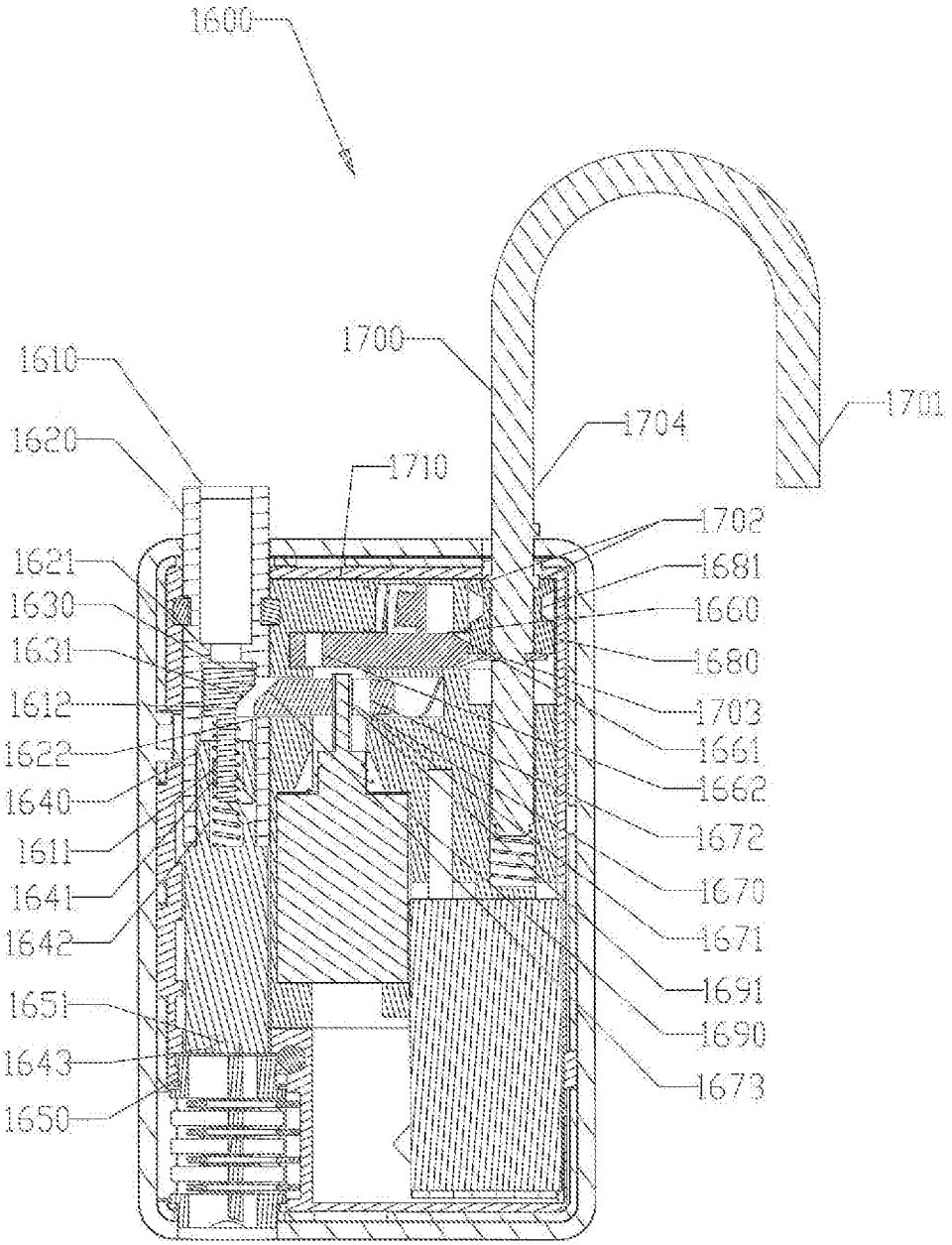
FIG. 52 illustrates the combination lock unlocked by the electronic-lock mechanism, according to an embodiment of the present invention.

Active State—Unlocked by Electronic-Lock Mechanism (FIG. 52)

When the padlock 1600 is in the active state, it can be unlocked by the electronic-lock mechanism as follows.

As seen in FIG. 39, when the padlock 1600 is operated in the locked mode, the groove 1661 of the single-hole latch 1660 is engaged with the ring neck 1681 of the locking ring 1680, and the tip of the shaft 1691 of the solenoid 1690 is located in the locking hole 1662 of the single-hole latch 1660. As such, the shackle 1700 cannot be pulled upward to unlock the padlock 1600. In order to release the shackle 1700 from the single-hole latch 1660, the shaft 1691 of the solenoid 1690 can be caused to move halfway downward away from the locking hole 1662 of the single-hole latch 1600. As the padlock 1700 also has a processor 520, a driving electronic circuit 530 as shown in FIG. 31, the driving electronic circuit 530 is arranged to cause the shaft 1691 of the solenoid 1690 to move halfway downward upon receiving a combination code from the keypad 1740 (see FIG. 38) or a correct password conveyed in a wireless signal from an electronic device 700 (see FIGS. 34, 35A-35E). As the shaft 1691 of the solenoid 1690 is moved halfway downward, the shaft 1691 is disengaged from the locking hole 1662 of the single-hole latch 1660 while the shaft 1691 is still located in the activating hole 1671 of the double-hole latch 1670.

While the shaft 1691 is disengaged from the latch hole 1662 of the single-hole latch 1660, a spring 1664 at the single-hole latch 1660 (see FIG. 51) is arranged to urge the single-hole latch 1660 to remain in contact with the locking ring 1680. However, the shackle 1700 can be pulled upward to disengage the short leg 1701 from the blocking plate 1610. The shackle 1700 can then be rotated to change the combination lock 1600 from the locked mode to the opened mode as shown in FIG. 52.

Figure 53:
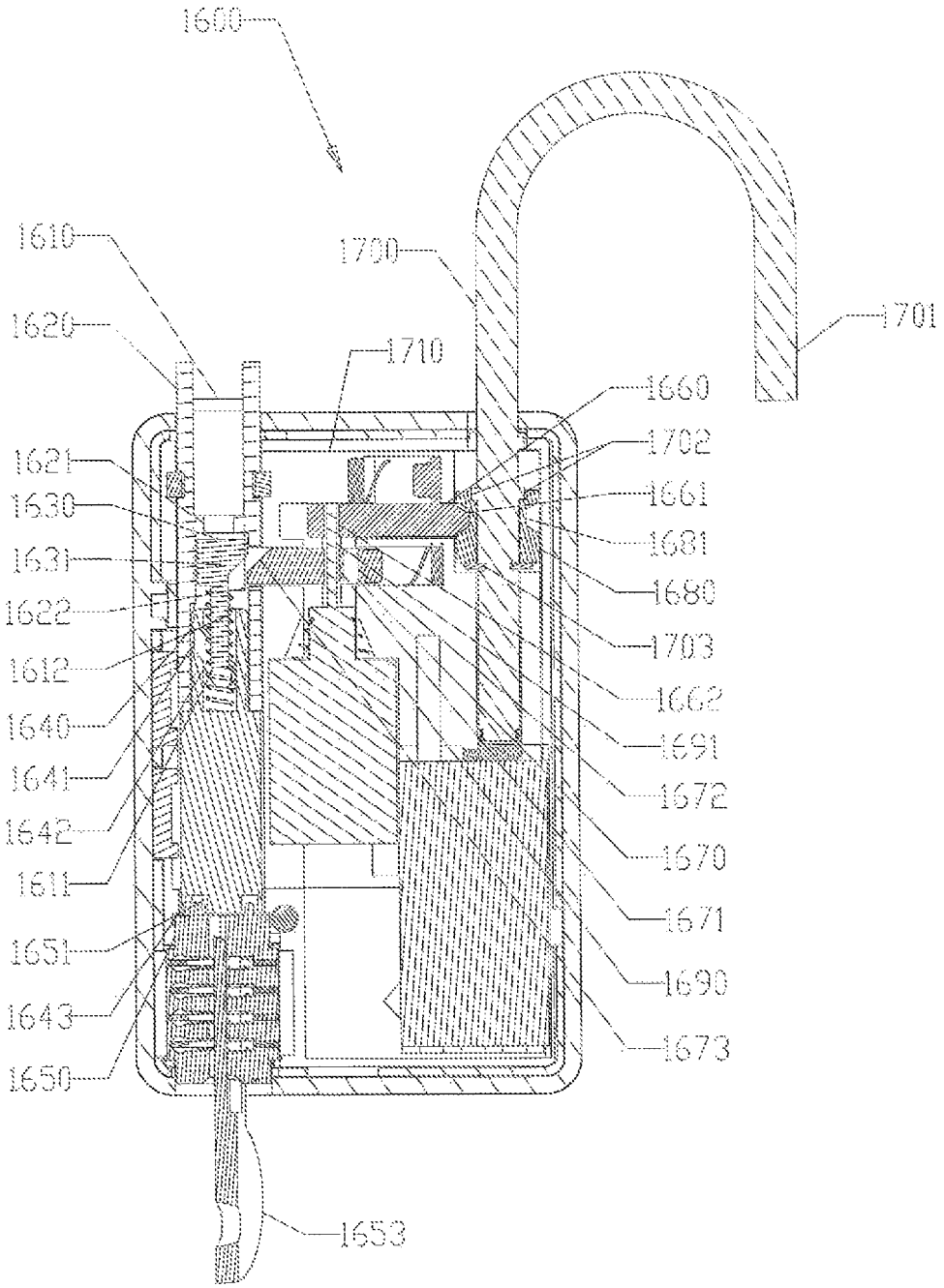
FIG. 53 illustrates the combination lock unlocked by the key-lock mechanism, according to an embodiment of the present invention.

Active State—Unlocked by Key-Lock Mechanism (FIG. 53)

When a correct key is inserted into the cylinder 1650 to rotate the cylinder 1650, the rotatable cam 1640 is also rotated in the same manner. As the driving pin 1611 of the block plate 1610 is movably engaged in the pin slope 1641 of the rotatable cam 1640, the pin slope 1641 causes the blocking plate 1610 to move downward relative to the fixed cam 1620 so as to release the short leg 1701 of the shackle 1700. While the single-hole latch 1660 remains engaged with the locking ring 1680, the shackle 1700 can be rotated to change the padlock 1600 from the locked position to the opened position.

Figure 37B:
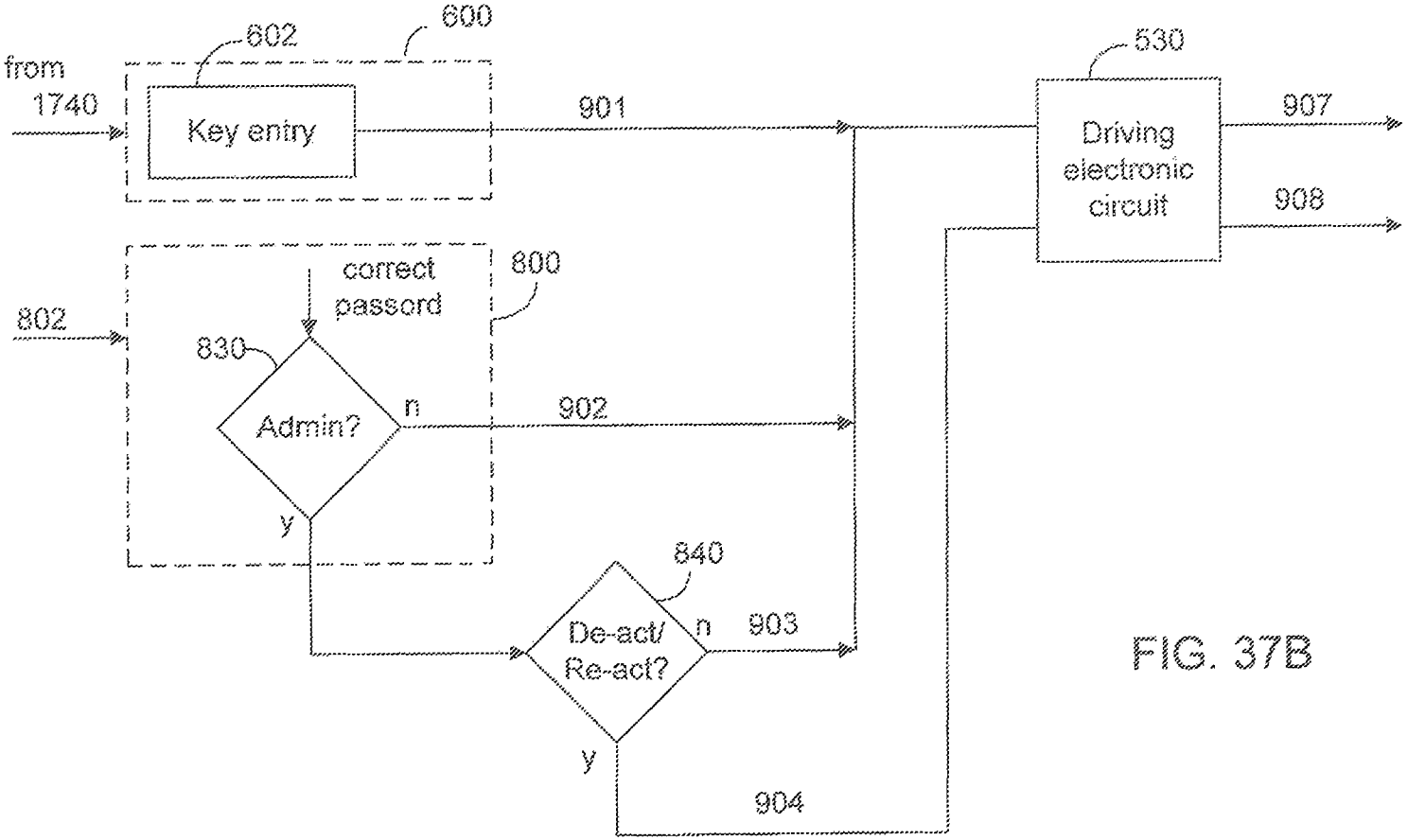
FIG. 37B is a flowchart showing the deactivation and re-activation of the touch panel and the key-lock mechanism by an electronic circuit according to an embodiment of the present invention.
Figure 54A:
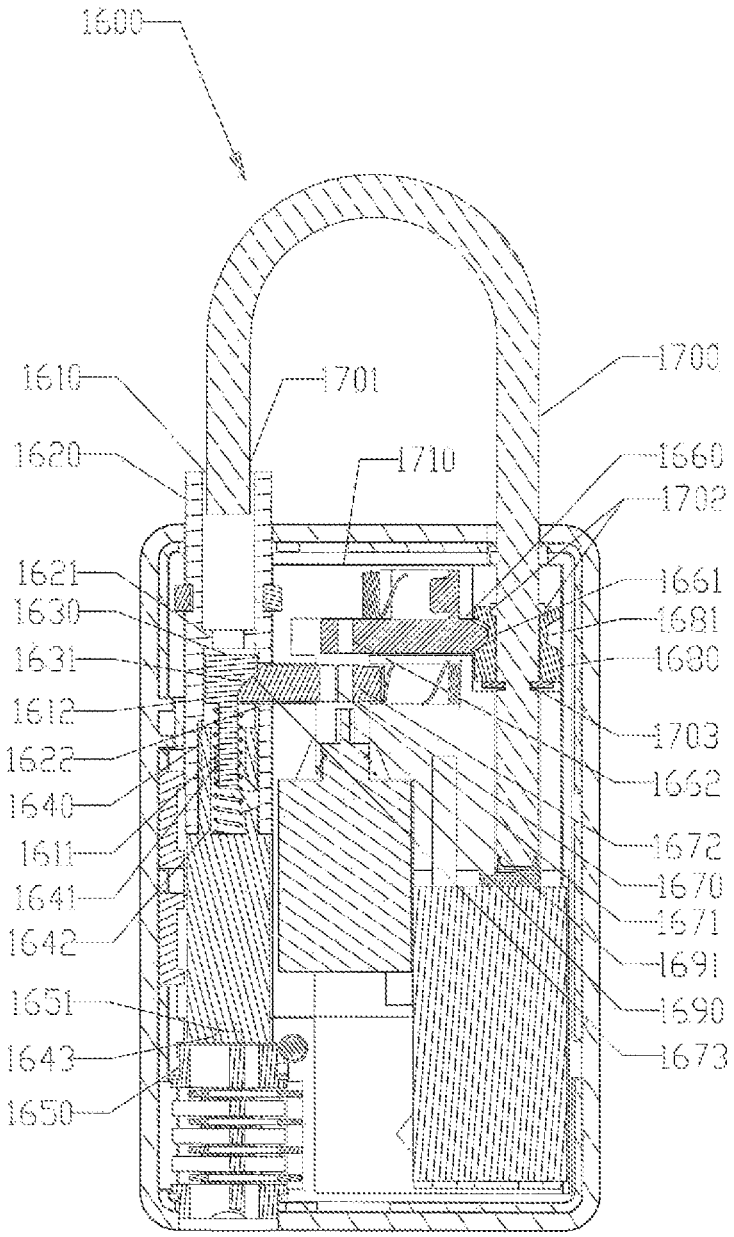
FIG. 54A illustrates the shaft of the solenoid fully retracted to allow the locking latch to engage with the rod in the key-lock mechanism, according to an embodiment of the present invention.
Figure 54B:
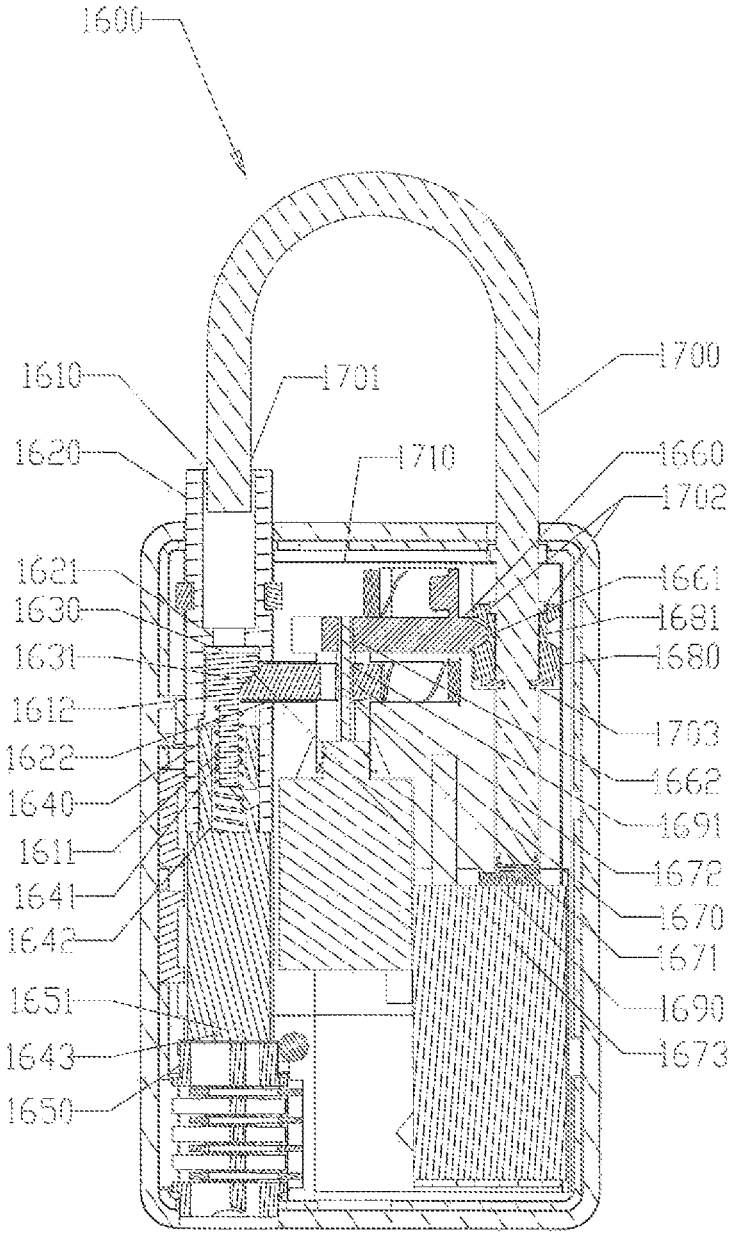
FIG. 54B illustrates the shaft of the solenoid engaged in both the controlling latch and the locking latch to disable both key-lock mechanism and the electronic-lock mechanism.

Deactivated State (FIGS. 37B, 54A-54B)

When the padlock 1600 is in the deactivation state as a result of a command from a first-level user of the detached electronic device 700, the padlock 1600 cannot be unlocked by a correct key or by a combination code entered via the touch panel 1740 by any user. For example, the first-level user can activate the "deactivation" icon 716 on the display 710 of the electronic device 700 to disable both the touch panel 1740 and the key-lock mechanism of the padlock 1600.

When the padlock 1600 is in an active state and operated in the locked mode as shown in FIG. 39, the shaft 1691 of the solenoid 1690 is located in both the locking hole 1662 of the single-hole latch 1660 and the activating hole 1671 of the double-hole latch 1670. When a first-level user activates the "deactivation" icon 716 on the display 710 of the electronic device 700, a wireless signal indicative of the deactivation function is conveyed to the padlock 1600 and received by the signal receiver 515 on the padlock 1600 as shown in FIG. 37B. As seen in FIG. 37B, the driving electronic circuit 530 is configured to send out two types of signals for energizing the solenoid 1690: an activating signal 907 and a deactivating/re-activation signal 908. As with some of the processing steps as shown in FIG. 37A, the driving electronic circuit 530 in FIG. 37B is arranged to send out the activating signal 907 when the combination code entered via the touch pad 1740 is valid or the password indicated in the wireless signal matches the combination code. However, the deactivation signal 908 is provided only when the user of the first level activates the deactivation icon 716 or the reactivation icon 717 (see FIG. 35F).

Responding to the activating signal 907, the shaft 1691 of solenoid 1690 is retracted halfway to release the single-hole latch 1660. Responding to the deactivating signal 908, the shaft 1691 of solenoid 1690 is retracted further downward to release both the single-hole latch 1660 and the double-hole latch 1670. As shown in FIG. 54A, when the shaft 1691 of solenoid 1690 is moved out of the activating hole 1671 of the double-hole latch 1670, a spring 1674 at the double-hole latch 1670 (see FIG. 51) urges the double-hole latch 1670 to move into the de-activating cutout 1612 of the blocking plate 1610. As such, the de-activating hole 1672 of the double-hole latch 1670 is aligned with the shaft 1691 of the solenoid 1690. At the same time, the groove 661 of the single-hole latch 1660 is kept in the locking ring 1681 of the locking ring 1680 by the urging force of the spring 1664 (see FIG. 51). As such, the latch hole 1662 of the single-hole latch 1660 is also aligned with the shaft 1691. After a predetermined time period, such as 10 seconds, the shaft 1691 is moved into the de-activating hole 1672 of the double-hole latch 1670 and the latch hole 1662 of the single-hole latch 1660 as shown in FIG. 54B. As the double-hole latch 1670 is engaged with the de-activating cutout 1612 of the blocking plate 1610, the blocking plate 1610 cannot move downward, preventing the padlock 1600 from being unlocked by the key-mechanism. Since the touch panel 1740 is also effectively disabled, the padlock 1600 can only be unlocked with a combination code conveyed from the mobile device 700 via a wireless signal. In an embodiment of the present invention, a user of the first, second or third access level can unlock the padlock 1600 with a correct combination code conveyed from the mobile device 700. In another embodiment of the present invention, only a user of the first access level can unlock the padlock 1600 via the wireless signal. According to a different embodiment of the present invention, a user of the first or second access level can unlock the padlock 1600 remotely.

Figure 55:
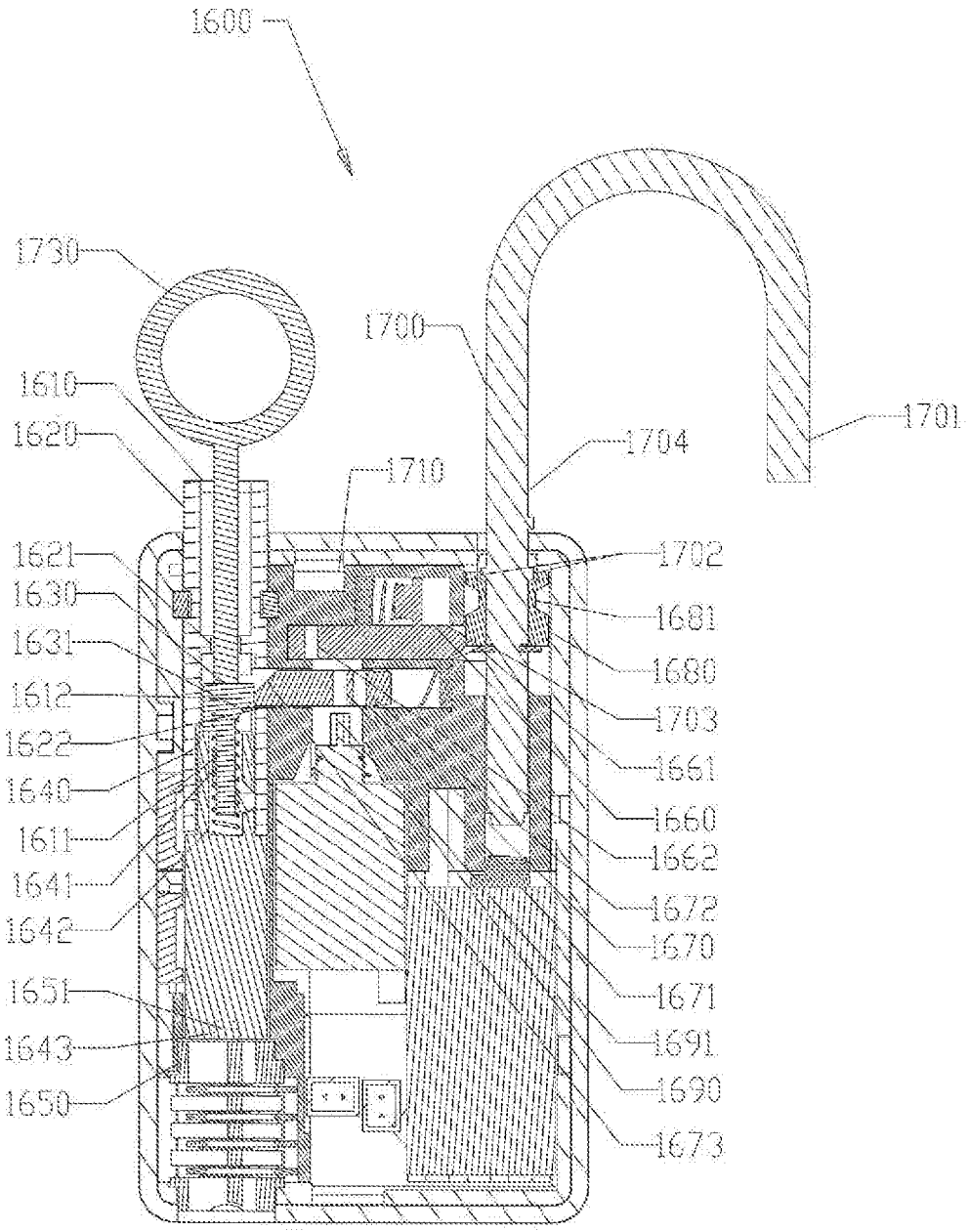
FIG. 55 illustrates the re-activation of the key-lock mechanism and the electronic-lock mechanism.

Re-Activation (FIG. 55)

When the padlock 1600 is in the deactivated state, only the user of a first level can "re-activate" the padlock 1600 by activating the "re-activation" icon 717. When a wireless re-activating signal from the electronic device is received by the processor 520 in the padlock 1600, the driving electronic circuit 530 sends out a deactivating/re-activating signal 908 to cause the shaft 1691 of the solenoid 1690 to retract fully to release both the single-hole latch 1660 and the double-hole latch 1670. The single-hole latch 1660 is urged by the spring to move away and disengaged from the ring neck 1681 of the locking ring 1680. As such, the shackle 1700 can be pulled upward to unlock the padlock 1600. The shackle 1700 can be rotated away from the blocking plate 1610 and the fixed cam 1620 as shown in FIG. 55. While the shaft 1691 of the solenoid 1690 is still disengaged from the double-hole latch 1670, a re-activating key 1730 can be inserted into the re-activating hole 1621 of the fixed cam 1620 to push the rod 1630 downward. As the rod 1630 is moved downward, the rod slope 1631 of the rod 1630 applies a force against the latch edge 1673 of the double-hole latch 1670, causing the double-hole latch 1670 to move away until the activating hole 1671 of the double-hole latch 1670 is aligned with the shaft 1691 of the solenoid 1690. After a predetermined time period, the shaft 1691 is moved back into the activating hole 1671. As such, the key-lock mechanism can be used to unlock the padlock 1600. It should be noted that the same signal 908 is used both in the deactivation and the reactivation of the padlock 1600. The signal 908 is only arranged to cause the shaft 1691 of the solenoid 1690 to retract fully within a predetermined period of the time. Therefore, the "deactivation" icon 716 and the "re-activation" icon 717 are effectively the same. Their only function is to cause the shaft 1691 of the solenoid to retract fully.

As with the padlock 40 which as a battery to power the solenoid 100 and a charging slot 122 for charging the battery, or the padlock 420 which has a battery to power the solenoid 300 and a charging slot 322 for charging the battery, the padlock 1600 has also has a battery to power the solenoid 1690 and a charging slot (not shown). A battery 510 as depicted in FIG. 31 is representative of the battery used in the padlock 10, 420 or 1600.

Thus, although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. An electronic combination lock operable in a locked mode, an opened mode and a reset mode, the combination lock comprising:

an electronic circuit configured to communicate with a mobile device via wireless signals, the wireless signals indicative of a combination code for operating the electronic combination lock at one of a plurality of access levels, the plurality of access levels comprising at least a first level and a second level;

a touch panel arranged to receive information indicative of a keypad entry code for operating the combination lock independently of the mobile device;

a non-transitory memory configured to store a plurality of preset codes, the plurality of preset codes comprising at least a present code for the first level and a preset code for the second level;

a processor configured to compare the plurality of preset codes with the keypad entry code from the touch panel or a received combination code from the mobile device and to allow access of the combination lock if the keypad entry code or the received combination code is indicative of one of the preset codes, wherein the preset code for the second level is indicative of a permission to access the combination lock, and the preset code for the first level is indicative of a permission to access the combination lock an unlimited number of times and a permission to change the preset code for all access levels, wherein the mobile device comprises a display configured with a deactivation icon associated only with the preset code for the first level, and when the deactivation icon is activated, the wireless signals are arranged to cause a disablement of the touch panel in receiving the information indicative of the keypad entry code.

2. The electronic combination lock according to claim 1, where the combination code for the second level is further indicative of a permission to access the combination lock an unlimited number of access times, and wherein the plurality of access levels further comprise a third level, wherein the combination code for the third access level is indicative of a permission to access the combination lock a limited number of access times.

3. The electronic combination lock according to claim 1, wherein the display is configured with an application icon configured for communication with the combination lock via the wireless signals when the application icon is activated.

4. The electronic combination lock according to claim 1, wherein the display is also configured with a re-activation icon associated only with the preset code for the first level, and when the re-activation icon is activated, the wireless signals are arranged to terminate the disablement of the touch panel, allowing the touch panel to receive information indicative of the keypad entry.

5. An electronic combination lock operable in a locked mode, an opened mode and a reset mode, the combination lock comprising:

an electronic circuit configured to communicate with a mobile device via wireless signals, the wireless signals indicative of a combination code for operating the electronic combination lock at one of a plurality of access levels, the plurality of access levels comprising at least a first level and a second level;

a touch panel arranged to receive information indicative of a keypad entry code for operating the combination lock independently of the mobile device;

a non-transitory memory configured to store a plurality of preset codes, the plurality of preset codes comprising at least a present code for the first level and a preset code for the second level;

a processor configured to compare the plurality of preset codes with the keypad entry code from the touch panel or a received combination code from the mobile device and to allow access of the combination lock if the keypad entry code or the received combination code is indicative of one of the preset codes, wherein the preset code for the second level is indicative of a permission to access the combination lock, and the preset code for the first level is indicative of a permission to access the combination lock an unlimited number of times and a permission to change the preset code for all access levels, said electronic combination lock further comprising:

a lock body having a first body side, an opposing body side and an inner case located between the first body side and the second body side, the inner case having a shackle channel;

a shackle having a long leg and a short leg, the long leg arranged for placement in the shack channel, the short leg located on the first body side of the lock body when the combination lock is operated in the locked mode;

a controlling latch having a latch hole, the controlling latch arranged to engage with the long leg of the shackle when the combination lock is operated in the locked mode, preventing the shackle from moving in a first direction toward the first body side of the lock body to unlock the combination lock;

a solenoid having a retractable shaft, wherein when the combination lock is operated in the locked mode, the shaft is received in the latch hole, securing the controlling latch in engagement with the long leg of the shackle; and a blocking plate engageable with the short leg of the shackle when the combination lock is operated in the locked mode, wherein the blocking plate comprises a driving pin, the blocking plate locatable in a first plate position and a second plate position, said combination lock further comprising a key-lock mechanism configured to unlock the combination lock independently of the keypad entry code and the mobile device when the lock is operated in the locked mode, the key-lock mechanism comprising:

a cylinder having a first cylinder end and an opposing second cylinder end, the second cylinder end arranged to receive a key for operating the combination lock;

a rotatable cam having a first segment and a second segment, the second segment engaged with the first cylinder end of the cylinder for rotation together, the first segment having a pin slot arranged to receive the driving pin of the blocking plate;

a fixed cam fixedly disposed in the lock body near the first body side, the fixed cam having a first portion and a second portion, the second portion having an opening dimensioned to receive the first segment of the rotatable cam with the driving pin of the blocking plate received in the pin slot of the rotatable cam, the first portion arranged to engage with the blocking plate to receive the short leg of the shackle when the blocking plate is located at the first plate position.

6. The electronic combination lock according to claim 5, wherein when the key is received into the second cylinder end, the cylinder can be caused to rotate along with the rotatable cam, and the pin slot in the rotatable cam is arranged to move the driving pin of the blocking plate in a second direction opposite to the first direction so as to shift the blocking plate from the first plate position to the second plate position, and wherein when the blocking plate is located in the second plate position, the shackle can be rotated relative to the shackle channel to change the combination lock from the locked mode to the opened mode.

7. The electronic combination lock according to claim 6, wherein the blocking plate further comprises a deactivating cutout positioned in relationship to the driving pin, said combination lock further comprising:

a locking latch operable between a blocking position and a releasing position, the locking latch having a latch edge and an activating hole, wherein when the locking latch is positioned in the blocking position, the latch edge is engaged with the deactivating cutout of the blocking plate, preventing the blocking plate from shifting from the first plate position to the second plate position, and wherein when the locking latch is positioned in the releasing position, the latch edge is spaced from the deactivating cutout so as to allow the blocking plate to shift from the first plate position to the second plate position, and wherein when the controlling latch is engaged with the long leg of the shackle to maintain the combination lock in the locked mode, the shaft of the solenoid is also engaged in the activating hole of the locking latch so as to keep the locking latch in the releasing position.

8. The electronic combination lock according to claim 7, wherein when the combination lock is operated in the locked mode, the shaft of the solenoid can be caused to retract from the latch hole of the controlling latch so as to allow the long leg of the shackle to move in the first direction to unlock the combination lock.

9. The electronic combination lock according to claim 8, wherein when the keypad entry code or the received combination code is indicative of one of the preset codes as determined by the processor, the shaft of the solenoid is caused to retract from the latch hole of the controlling latch.

10. The electronic combination lock according to claim 7, wherein the key-lock mechanism further comprises a first spring arranged to urge the locking latch to move toward the deactivating cutout of the blocking plate, and wherein when the combination lock is operated in the locked mode, the shaft of the solenoid can be caused to disengage from the activating hole of the locking hole, and the latch plate is caused to move from the releasing position to the blocking position, preventing the blocking plate from shifting from the first plate position to the second plate position for unlocking the combination lock.

11. The electronic combination lock according to claim 10, wherein the mobile device comprises a display configured with a deactivation icon associated only with the preset code for the first level, and when the deactivation icon is activated, the wireless signals are arranged to cause a disablement of the touch panel in receiving the keypad entry code, and the wireless signals are also arrange to cause the shaft of the solenoid to disengage from the activating hole of the locking latch.

12. The electronic combination lock according to claim 11, wherein the locking latch further comprises a deactivating hole positioned in relationship to the activating hole, the combination lock furthering comprising a second spring arranged to urge the controlling latch to move toward the long leg of the shackle, wherein when the locking latch is located in the blocking position, both the deactivating hole of the locking latch and the latch hole of the controlling latch are aligned with the shaft of the solenoid, and the shaft of the solenoid is arranged to engage with both the deactivating hole of the locking latch and the latch hole of the controlling latch so as to prevent the blocking plate from shifting from the first plate position to the second plate position and the long leg of the shackle from moving in the first direction to unlock the combination lock.

13. The electronic combination lock according to claim 12, wherein the key-lock mechanism further comprises a rod positioned in relationship to the blocking plate, the rod having a rod slope arranged to contact with the latch edge of the locking latch when the locking edge of the locking latch is positioned in the blocking position, and wherein the display of the mobile device is further configured with a re-activation icon associated only with the preset code for the first level, and when the re-activation icon is activated, the wireless signals are arranged to terminate the disablement of the touch panel in receiving the information indicative of the keypad entry code, and the wireless signals are also arrange to cause the shaft of the solenoid to disengage from both the deactivating hole of the locking latch and the locking hole of the controlling latch, and when the shaft of the solenoid is disengaged from locking hole of the controlling latch, the long leg of the shackle can be caused to move in the first direction to unlock the combination lock so as to allow the short leg to move away from the blocking plate, and when the shaft of the solenoid is disengaged from the deactivating hole of the locking latch, the rod can be caused to move in the second direction so as to disengage the latch edge of the locking latch from the deactivating cutout of the blocking plate.

14. A mobile device, comprising:

a display configured with an application icon arranged for communications with a combination lock, and an electronic circuit configured to provide wireless signals when the application icon is activated, the wireless signals indicative of a combination code for operating the combination lock at one of a plurality of access levels, the access levels comprising at least a first level and a second level, wherein the combination code for the second level is indicative of a permission to access the combination lock, and the combination code for the first level is indicative of a permission to access the combination lock an unlimited number of times and a permission to change the combination code for all access levels, wherein the combination lock comprises a touch panel arranged to receive information indicative of a keypad entry for operating the combination lock independently of the wireless signals, and wherein the display is further configured with a deactivation icon associated only with the combination code for the first level, and when the deactivation icon is activated, the wireless signals are arranged to cause a disablement of the touch panel in receiving the information indicative of the keypad entry.

15. The mobile device according to claim 14, wherein the combination lock further comprises a key-lock mechanism configured to unlock the combination lock by a key independently of the keypad entry and the wireless signals, and wherein when the deactivation icon is activated, the wireless signals are also arranged to cause a disablement of the key-lock mechanism.

16. The mobile device according to claim 15, wherein the key-lock mechanism further comprises a re-activation mechanism to terminate the disablement of the key-lock mechanism independently of the wireless signals.

17. The mobile device according to claim 14, wherein the display is also configured with a re-activation icon associated only with the combination code for the first level, and when the re-activation icon is activated, the wireless signals are arranged to terminate the disablement of the touch panel, allowing the touch panel to receive information indicative of the keypad entry.

18. The mobile device according to claim 14, where the combination code for the second level is further indicative of a permission to access the combination lock an unlimited number of access times, and wherein the plurality of access levels further comprise a third level, wherein the combination code for the third access level is indicative of a permission to access the combination lock a limited number of access times.

* * * * *